US009140054B2

(12) United States Patent
Oberbroeckling

(10) Patent No.: US 9,140,054 B2
(45) **Date of Patent: *Sep. 22, 2015**

(54) INSERT HOLDING SYSTEM

(71) Applicant: Oberbroeckling Development Company, LLC, Kingwood, TX (US)

(72) Inventor: Philip J. Oberbroeckling, Kingwood, TX (US)

(73) Assignee: Oberbroeckling Development Company, Kingwood, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/210,810

(22) Filed: Mar. 14, 2014

(65) Prior Publication Data

US 2014/0259948 A1 Sep. 18, 2014

Related U.S. Application Data

(60) Provisional application No. 61/781,933, filed on Mar. 14, 2013.

(51) Int. Cl.

| | |
|---|---|
| ***E06B 3/70*** | (2006.01) |
| ***E06B 3/72*** | (2006.01) |
| ***E06B 3/58*** | (2006.01) |
| *E06B 5/00* | (2006.01) |
| *E06B 7/30* | (2006.01) |
| *E06B 9/52* | (2006.01) |

(52) U.S. Cl.

CPC ..... *E06B 3/7001* (2013.01); *E06B 3/5892* (2013.01); *E06B 3/72* (2013.01); *E06B 5/003* (2013.01); *E06B 7/30* (2013.01); *E06B 9/52* (2013.01); *E06B 2003/7011* (2013.01)

(58) Field of Classification Search

CPC ..... E06B 7/30; E06B 5/003; E06B 9/52; E06B 9/525; E06B 9/527; E06B 9/528

USPC ..... 52/270, 204.51, 204.61, 204.71, 52/204.72, 656.1, 656.2, 656.4, 656.8, 52/455; 49/505, 63; 160/90, 91

See application file for complete search history.

(56) References Cited

U.S. PATENT DOCUMENTS

| | | | | |
|---|---|---|---|---|
| 1,207,885 A | | 12/1916 | Estabrook | |
| 1,370,500 A | | 3/1921 | Jones | |
| 1,573,194 A | | 2/1926 | Roe | |
| 2,634,146 A | | 4/1953 | Johnson | |
| 3,184,801 A | * | 5/1965 | Fletcher | 49/459 |
| 3,226,903 A | * | 1/1966 | Lillethun | 52/172 |
| 3,414,039 A | | 12/1968 | King | |
| 4,271,892 A | | 6/1981 | Brusseau et al. | |
| 4,467,579 A | | 8/1984 | Weinar | |

(Continued)

*Primary Examiner* — Chi Q Nguyen

(74) *Attorney, Agent, or Firm* — Jeffrey D. Mulrooney

(57) ABSTRACT

The present invention is directed to an insert holding system, a kit, and a method of installing the same. In several embodiments, the kit and/or system is constructed so that it can be installed in a standard interior door by modifying the existing door. In other embodiments, the insert holding system is installed in a door during the manufacturing of the door. The system and kit can also be configured to be installed in a wall, furniture, or another item or fixture. In several embodiments, the insert is constructed in a modular frame for easy replacement and exchange of the insert, if damaged, or if a different functionality is desired. For example, the insert could include a screen, a window, a mirror, a poster frame, a picture frame, a poster, a chalk board, a dry erase board, a cork board, or any combination thereof.

15 Claims, 26 Drawing Sheets

(56) References Cited

U.S. PATENT DOCUMENTS

| | | | | |
|---|---|---|---|---|
| 4,602,405 | A | 7/1986 | Sturman et al. | |
| 4,702,297 | A | 10/1987 | Van Klompenburg | |
| 5,018,330 | A * | 5/1991 | Lewkowitz | 52/455 |
| 5,365,706 | A | 11/1994 | Elsenpeter et al. | |
| 5,487,243 | A | 1/1996 | Hale et al. | |
| 5,497,588 | A | 3/1996 | Martin et al. | |
| 5,829,218 | A | 11/1998 | Murray et al. | |
| 5,887,391 | A * | 3/1999 | Shoup | 52/202 |
| 5,901,768 | A | 5/1999 | Herbst | |
| 5,967,215 | A | 10/1999 | Needham et al. | |
| 6,161,363 | A | 12/2000 | Herbst | |
| 6,209,272 | B1 | 4/2001 | Holzaepfel | |
| 6,233,888 | B1 | 5/2001 | Wu | |
| 6,250,040 | B1 | 6/2001 | Green | |
| 6,272,801 | B1 * | 8/2001 | Suh | 52/211 |
| 6,578,305 | B2 | 6/2003 | Lebrun | |
| 6,736,534 | B1 | 5/2004 | Fite | |
| 7,331,617 | B2 | 2/2008 | Johnson | |
| 7,484,286 | B2 | 2/2009 | Fowler | |
| 7,587,847 | B2 | 9/2009 | Lasher | |
| 8,627,630 | B2 | 1/2014 | Oberbroeckling | |
| 2004/0003559 | A1 | 1/2004 | Minke et al. | |
| 2005/0102908 | A1 | 5/2005 | Martin | |

* cited by examiner 20
22
32
34
36
40
42
46
52

26
24
32
34
48
50
52

28
60

62
A
B 30
60
68

30
60
68

60
60
30
68

62
30
62

C
62
30
62
62

D

2-Skin Hollow Core Door
Through-Opening
(during manufacturing installation)

2-Skin Hollow Core Door
Through-Opening
(after manufacturing installation)

Solid Core Door
Through-Opening

2-Skin Hollow Core Door
Single-Side Opening

2-Skin Hollow Core Door
Through-Opening

INSERT HOLDING SYSTEM

CROSS REFERENCE TO RELATED APPLICATIONS

This application is related to and claims priority from U.S. Provisional Patent Application No. 61/781,933 filed Mar. 14, 2013. Additionally, this application is related to U.S. patent application Ser. No. 12/478,859 filed Jun. 5, 2009, now abandoned, and U.S. patent application Ser. No. 12/756,398, which issued as U.S. Pat. No. 8,627,630 on Jan. 14, 2014 and which are herein incorporated by reference in their entireties.

BACKGROUND OF THE INVENTION

Field of the Invention

The invention is particularly applicable to interior doors and will be described with particular reference thereto. However, it will be appreciated by those skilled in the art that the invention has broader applications and may also be adapted for use in exterior doors, tree house doors, or other door applications. It will also be appreciated by those skilled in the art that the invention has broader applications such as for allowing for the holding of inserts on or in any structure or device with a relatively planar surface.

It has been considered desirable to develop a door that has the ability to accept a number of different inserts to allow the door to have different functions by easily changing the insert; particularly, to allow the door to be changed between having a through viewing area and being fully enclosed for privacy. Additionally, it has been considered desirable to have doors that are designed to accept different inserts that also are designed to fit in a standard home interior door frame designed to hold a standard 1⅜-inch thick door where the door can fit into an existing doorway without on-site alterations to properly fit and be properly secured in a standard interior doorway. Additionally, it has been considered desirable to have an interior door designed to accept an array of different inserts that allow the door to have a change in its function, or designed to accept a combination of different inserts to provide a change in the function of the door that differs from the front of the door to the rear of the door. Additionally, it has been considered desirable to develop a door designed to be a standard door panel on one side and have the ability to accommodate an interchangeable insert to be installed on the opposite side.

Interior doors have many different methods of manufacture and are available with many different visual designs. Interior doors can be manufactured as a hollow core or solid core door. Hollow core doors often consist of a core of lattice or honeycomb made of corrugated cardboard, or thin wooden slats. They can also be built with staggered wooden blocks or staggered foam or cardboard spacers. The external shell ("skins") of a hollow core door are either press-mold fabricated using compressed paper/wood bonded or hard plastic materials or other similar materials allowing for aesthetic designs such as panels; or fabricated with wood veneering giving the appearance of a flat wooden door. Compared to solid core doors, they are lighter, cost less to manufacture, durable (scratch resistant), and easier to install. Solid core interior doors are either manufactured from solid wood or medium density fiberboard (MDF) and are either fabricated with flat surfaces or patterned panel designs.

Accordingly, it has been considered desirable to develop a system, a kit, and a method to have the insert holding ability incorporated into an existing interior door design without significantly altering the door manufacturing methodology. Additionally, it has been considered desirable to develop a method to provide for the implementation of the insert holding ability into existing interior doors already installed into a home environment. It has been considered desirable to develop a modular system that has the ability to accept a number of different inserts to allow the system to have different functions by easily changing inserts that can be easily installed or applied to most existing door formats or surfaces with a relatively planar surface.

SUMMARY OF THE INVENTION

The present invention is directed to an insert holding system, a kit, and a method of installing the same. In several embodiments, the kit and/or system is constructed so that it can be installed in a standard interior door by modifying the existing door. In other embodiments, the insert holding system is installed in a door during the manufacturing of the door. The system and kit can also be configured to be installed in a wall, furniture, or another item or fixture. In several embodiments, the insert is constructed in a modular frame for easy replacement and exchange of the insert if damaged or if a different functionality is desired. For example, the insert could include a screen, a window, a mirror, a poster frame, a picture frame, a poster, a chalk board, a dry erase board, a cork board, or any combination thereof. In several embodiments, the insert can be installed or replaced without tools. The modular frame could hold one insert for display on one side of a door and hold another insert for display on the other side of the door.

In one embodiment, the present invention is an insert holding system including a modular housing defining a chamber, a substantially planar insert, the modular housing is configured to receive the substantially planar insert in the chamber; where the chamber of the modular housing is open at a first end and at a second end; and where the modular housing is configured to be disposed in an opening in a door or a planar surface. In another embodiment, the modular housing includes a first frame and a second frame, where the first frame is disposed at the first end of the chamber, and where the second frame is adapted to removably attach to the first frame at the second end of the chamber defining the chamber of the modular housing. In another embodiment, the insert holding system includes a mounting platform configured for receiving the modular housing, the mounting platform being further configured to mount into a through opening defined by a hollow core door, where the mounting platform is at least in part disposed in a cavity defined by the skin panels of the hollow core door, and where the mounting platform is fastened to the skin panels of the hollow core door. In another embodiment, the insert holding system includes a mounting platform formed integral with the modular housing forming an insert holding assembly, the insert holding assembly being formed from a plurality of sectional parts, the mounting platform being configured to mount into a through opening defined by a hollow core door, where the mounting platform is at least in part disposed in a cavity defined by the skin panels of the hollow core door, and where the mounting platform is fastened to the skin panels of the hollow core door. In another embodiment, the substantially planar insert includes a mesh screen. In another embodiment, the substantially planar insert includes a non-translucent insert, a mirror, a poster frame, a picture frame, a poster, a chalk board, a dry erase board, a cork board, or any combination thereof. In another embodiment, the substantially planar insert includes a section of translucent material. In another embodiment, the substantially planar insert includes a section of transparent material. In another embodiment, the substantially planar insert includes a plurality of layers of material. In another embodiment, the substantially planar insert is secured within the chamber by the second frame being attached to the first frame, by sliding the substantially planar insert and the first frame into the chamber without using a tool, and where the substantially planar insert and the second frame are removed from the chamber by sliding up and pulling out the second frame without using a tool. In another embodiment, the insert holding system is installed into a hollow core door including a first door panel on a first side of the hollow core door, a second door panel on a second side of the hollow core door, and an opening in the second door panel of the hollow core door on the second side, where the opening does not penetrate through the first door panel on the first side of the hollow core door. In another embodiment, the substantially planar insert includes a section of transparent material, such as glass, acrylic glass, or transparent polycarbonate, thus forming a window.

In another embodiment, the present invention is a kit for installing an insert holding system into a preexisting door. The kit includes a modular housing defining a chamber, a substantially planar insert, where the modular housing is configured to receive the substantially planar insert in the chamber, where the chamber of the modular housing is open at a first end and at a second end, and where the modular housing is configured to be disposed in an opening in a door. In another embodiment, the modular housing includes a first frame and a second frame, where the first frame is disposed at the first end of the chamber, and where the second frame is adapted to removably attach to the first frame at the second end of the chamber defining the chamber of the modular housing. In another embodiment, the kit further includes a mounting platform configured for receiving the modular housing, the mounting platform being further configured to mount into a through opening defined by a hollow core door, where the mounting platform is at least in part disposed in a cavity defined by the skin panels of the hollow core door, and where the mounting platform is fastened to the skin panels of the hollow core door. In another embodiment, the kit further includes a mounting platform formed integral with the modular housing forming an insert holding assembly, the insert holding assembly being formed from a plurality of sectional parts, the mounting platform being configured to mount into a through opening defined by a hollow core door, where the mounting platform is at least in part disposed in a cavity defined by the skin panels of the hollow core door, and where the mounting platform is fastened to the skin panels of the hollow core door. In another embodiment, the substantially planar insert includes a non-translucent insert, of any one of a mirror, a poster frame, a picture frame, a poster, a chalk board, a dry erase board, a cork board, and any combination thereof. In another embodiment, the substantially planar insert includes a section of transparent material, such as glass, acrylic glass, or transparent polycarbonate, thus forming a window.

In another embodiment, the present invention is a method of retrofitting a preexisting door with an insert holding system. The method includes the steps of removing a portion of the preexisting door thereby forming a void defined by the door, positioning a modular housing defining a chamber into the void, fastening the modular housing to the preexisting door, and where the modular housing is configured to receive a substantially planar insert in the chamber. In another embodiment, the modular housing includes a first frame and a second frame, where the first frame is disposed at the first end of the chamber, and where the second frame is removably attached to the first frame at the second end of the chamber defining the chamber of the modular housing. In another embodiment, the method further includes the steps of positioning a mounting platform configured for receiving the modular housing in a cavity defined by a plurality of skin panels of the preexisting door, and fastening the mounting platform to the plurality of skin panels of the preexisting door, where the preexisting door is a hollow core door. In another embodiment, the substantially planar insert includes a non-translucent insert, of any one of a mirror, a poster frame, a picture frame, a poster, a chalk board, a dry erase board, a cork board, or any combination thereof. In another embodiment, the substantially planar insert includes a section of transparent material, such as glass, acrylic glass, or transparent polycarbonate, thus forming a window.

It is to be understood that both the foregoing general description and the following detailed description are merely exemplary of the invention, and are intended to provide an overview or framework for understanding the nature and character of the invention as it is claimed. The accompanying drawings are included to provide a further understanding of the invention, and are incorporated in and constitute a part of this specification. The drawings illustrate various embodiments, of the invention; and together with the description serve to explain the principles and operation of the invention.

BRIEF DESCRIPTION OF THE DRAWING(S)

DETAILED DESCRIPTION OF THE INVENTION

Figure 1:
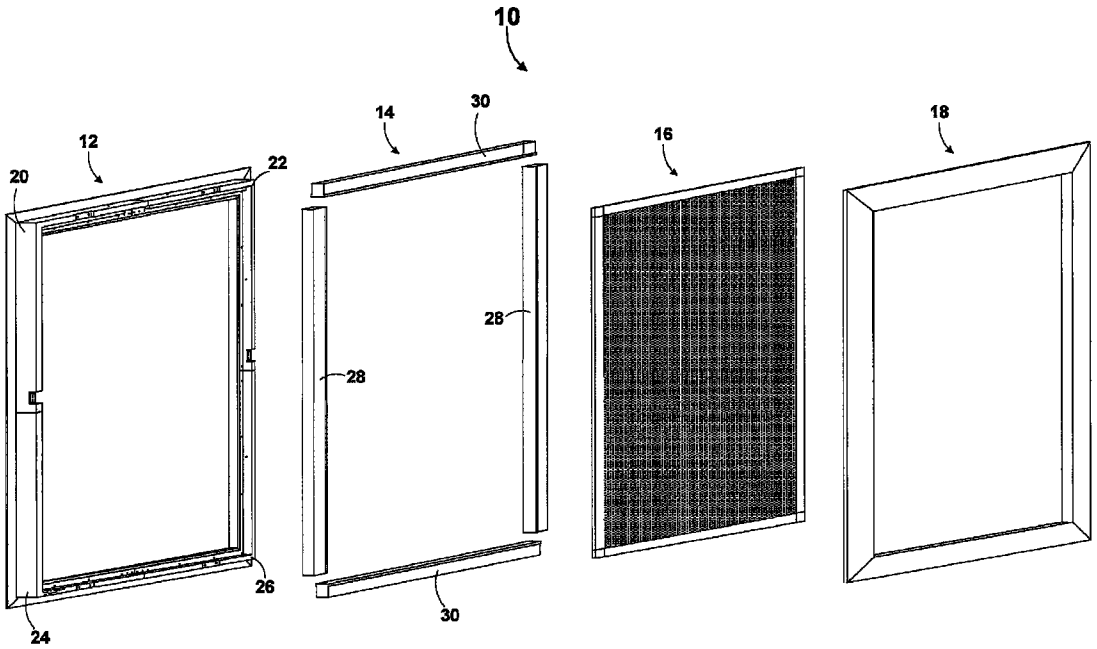
FIG. 1 is a perspective view of an insert holding system kit made in accordance with the present invention.
Figures 2A, 2B, 2C, 2D, 2E, 3A, 3B, 3C, 3D, 3E:
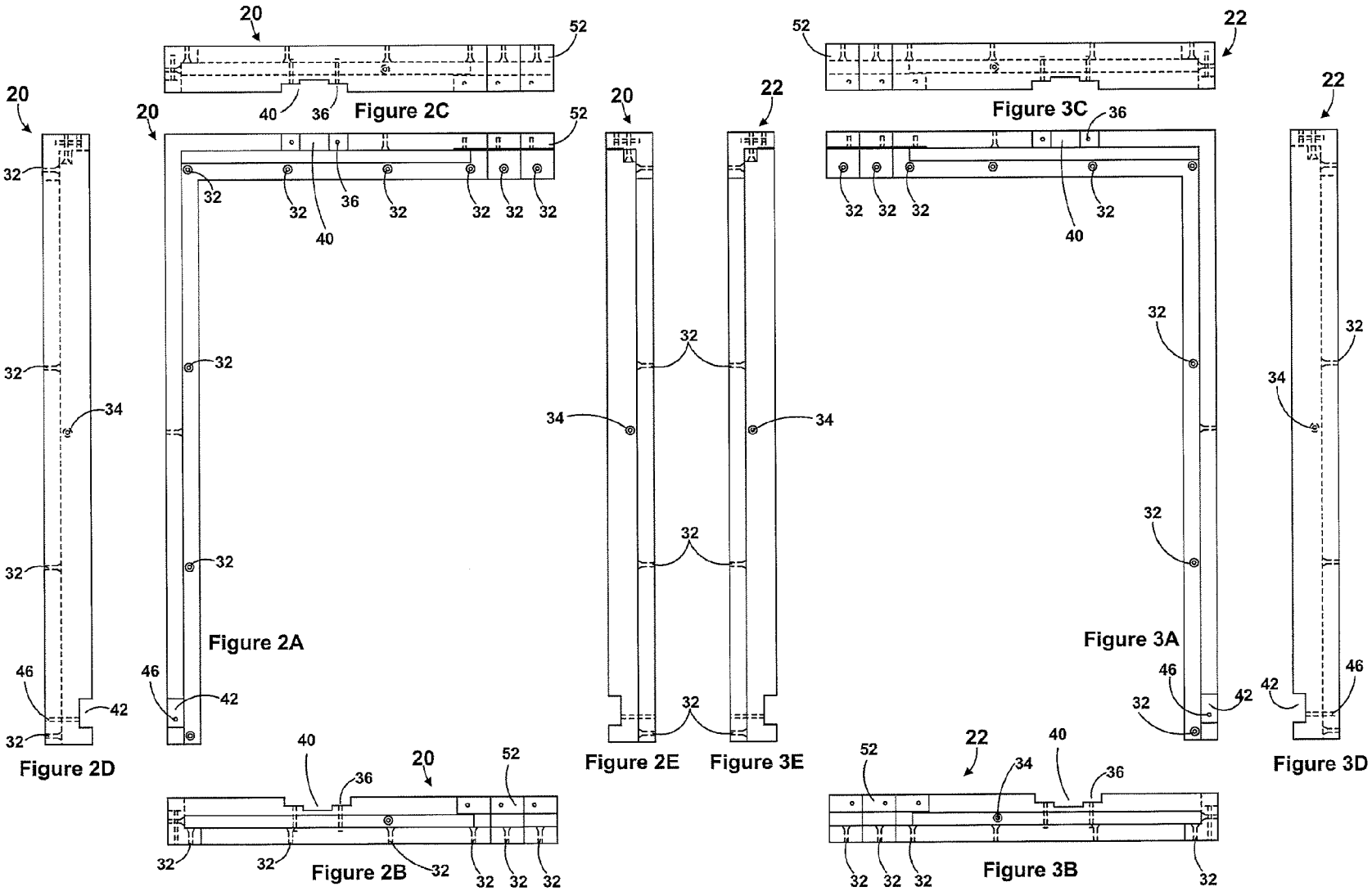
FIG. 2A is a front view of the upper left segment of the modular insert holding frame shown in FIG. 1.
FIG. 2B is a bottom view of the upper left segment of the modular insert holding frame shown in FIG. 1.
FIG. 2C is a top view of the upper left segment of the modular insert holding frame shown in FIG. 1.
FIG. 2D is a left side view of the upper left segment of the modular insert holding frame shown in FIG. 1.
FIG. 2E is a right side view of the upper left segment of the modular insert holding frame shown in FIG. 1.
FIG. 3A is a front view of the upper right segment of the modular insert holding frame shown in FIG. 1.
FIG. 3B is a bottom view of the upper right segment of the modular insert holding frame shown in FIG. 1.
FIG. 3C is a top view of the upper right segment of the modular insert holding frame shown in FIG. 1.
FIG. 3D is a right side view of the upper right segment of the modular insert holding frame shown in FIG. 1.
FIG. 3E is a left side view of the upper right segment of the modular insert holding frame shown in FIG. 1.
Figures 4A, 4B, 4C, 4D, 4E, 5A, 5B, 5C, 5D, 5E:
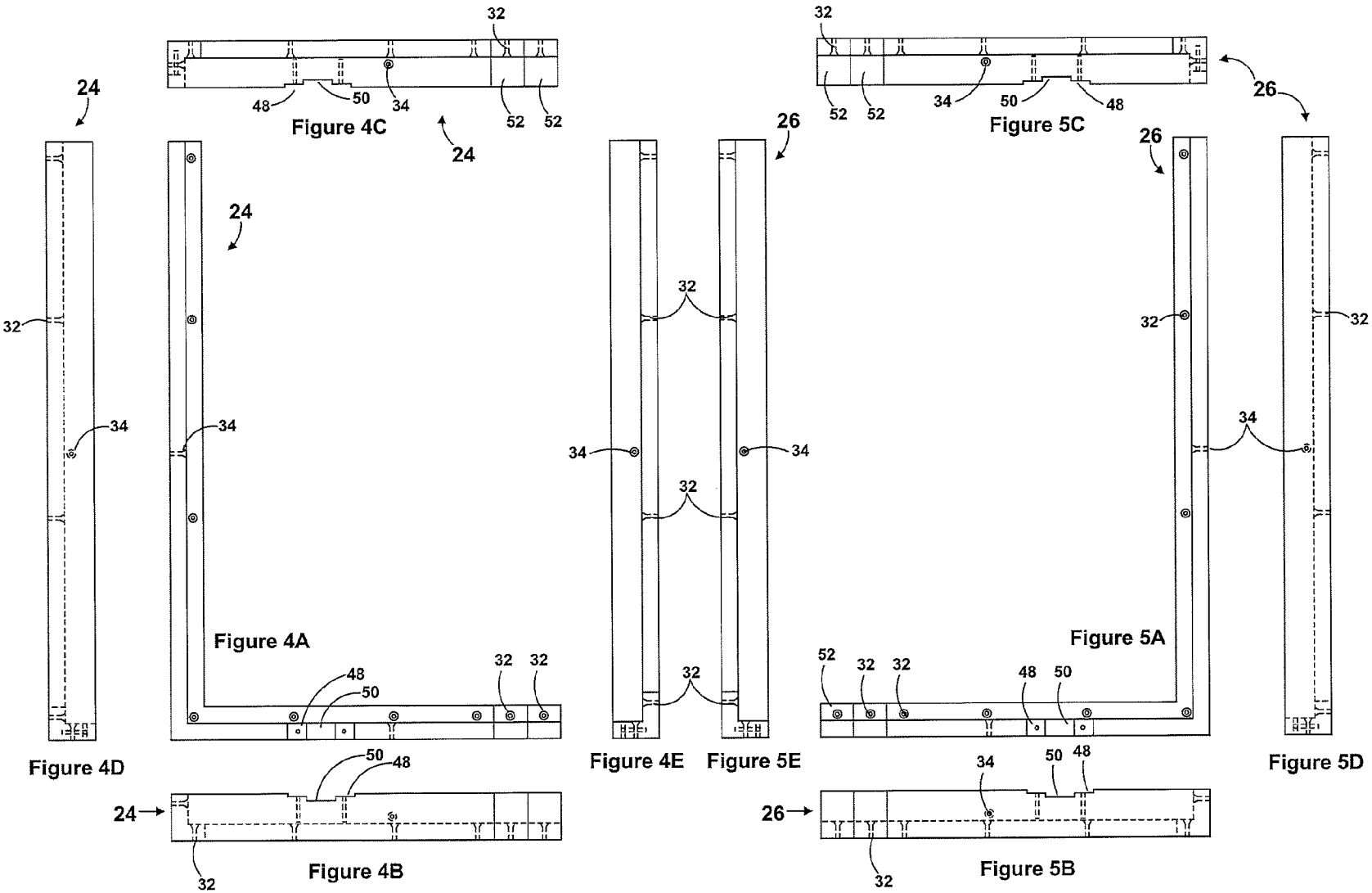
FIG. 4A is a front view of the lower left segment of the modular insert holding frame shown in FIG. 1.
FIG. 4B is a bottom view of the lower left segment of the modular insert holding frame shown in FIG. 1.
FIG. 4C is a top view of the lower left segment of the modular insert holding frame shown in FIG. 1.
FIG. 4D is a left side view of the lower left segment of the modular insert holding frame shown in FIG. 1.
FIG. 4E is a right side view of the lower left segment of the modular insert holding frame shown in FIG. 1.
FIG. 5A is a front view of the lower right segment of the modular insert holding frame shown in FIG. 1.
FIG. 5B is a bottom view of the lower right segment of the modular insert holding frame shown in FIG. 1.
FIG. 5C is a top view of the lower right segment of the modular insert holding frame shown in FIG. 1.
FIG. 5D is a right side view of the lower right segment of the modular insert holding frame shown in FIG. 1.
FIG. 5E is a left side view of the lower right segment of the modular insert holding frame shown in FIG. 1.
Figures 6A, 6B, 6C, 6D, 6E, 6F:
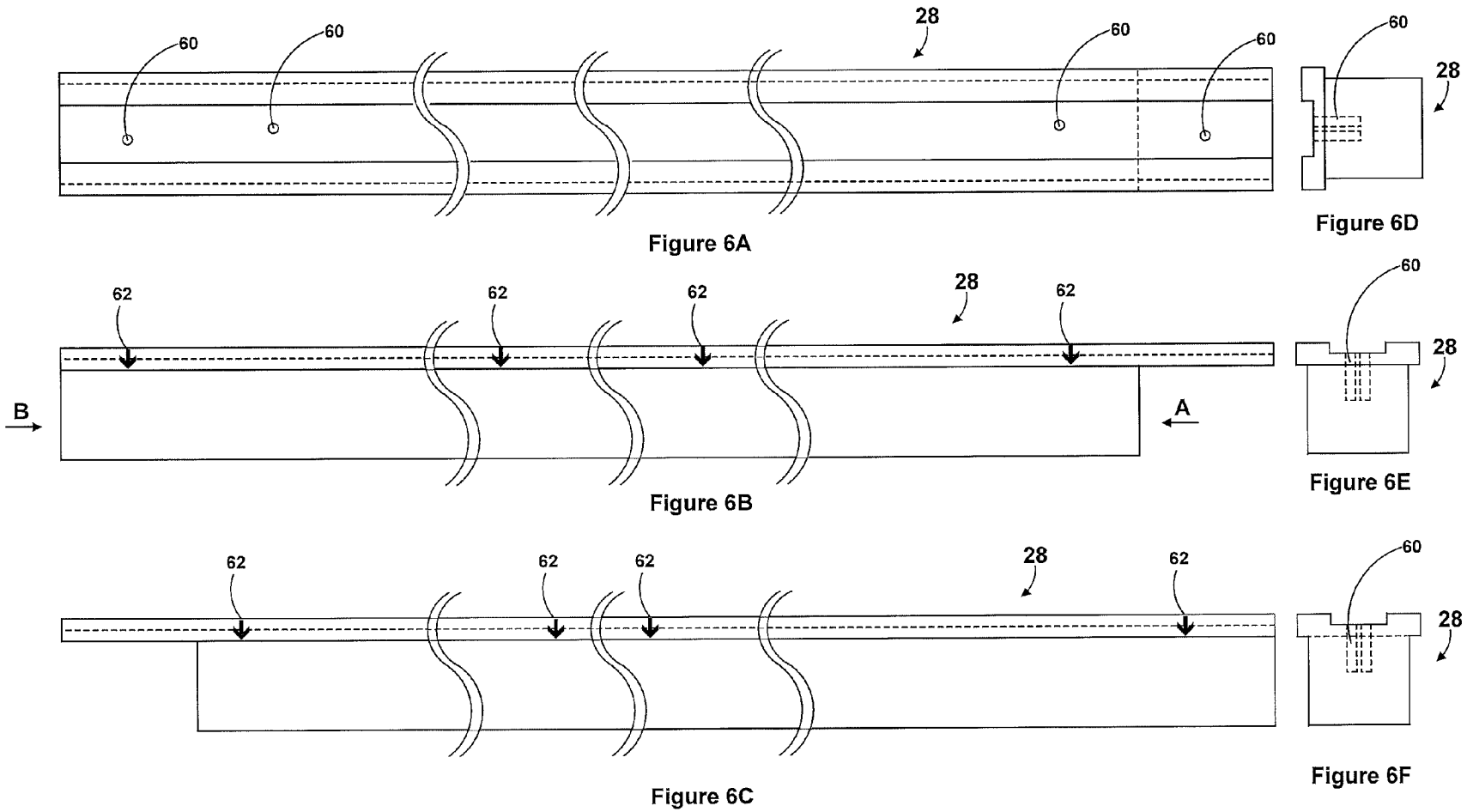
FIG. 6A is an interior side view of a side rail of the mounting platform shown in FIG. 1.
FIG. 6B is a front side view of a side rail of the mounting platform shown in FIG. 1.
FIG. 6C is a back side view of a side rail of the mounting platform shown in FIG. 1.
FIG. 6D is an end side view of a side rail of the mounting platform shown from the direction shown by directional arrow A in FIG. 6B.
FIG. 6E is an end side view of a side rail of the mounting platform shown from the direction shown by directional arrow A in FIG. 6B.
FIG. 6F is an end side view of a side rail of the mounting platform shown from the direction shown by directional arrow B in FIG. 6B.
Figures 7A, 7B, 7C, 7D, 7E:
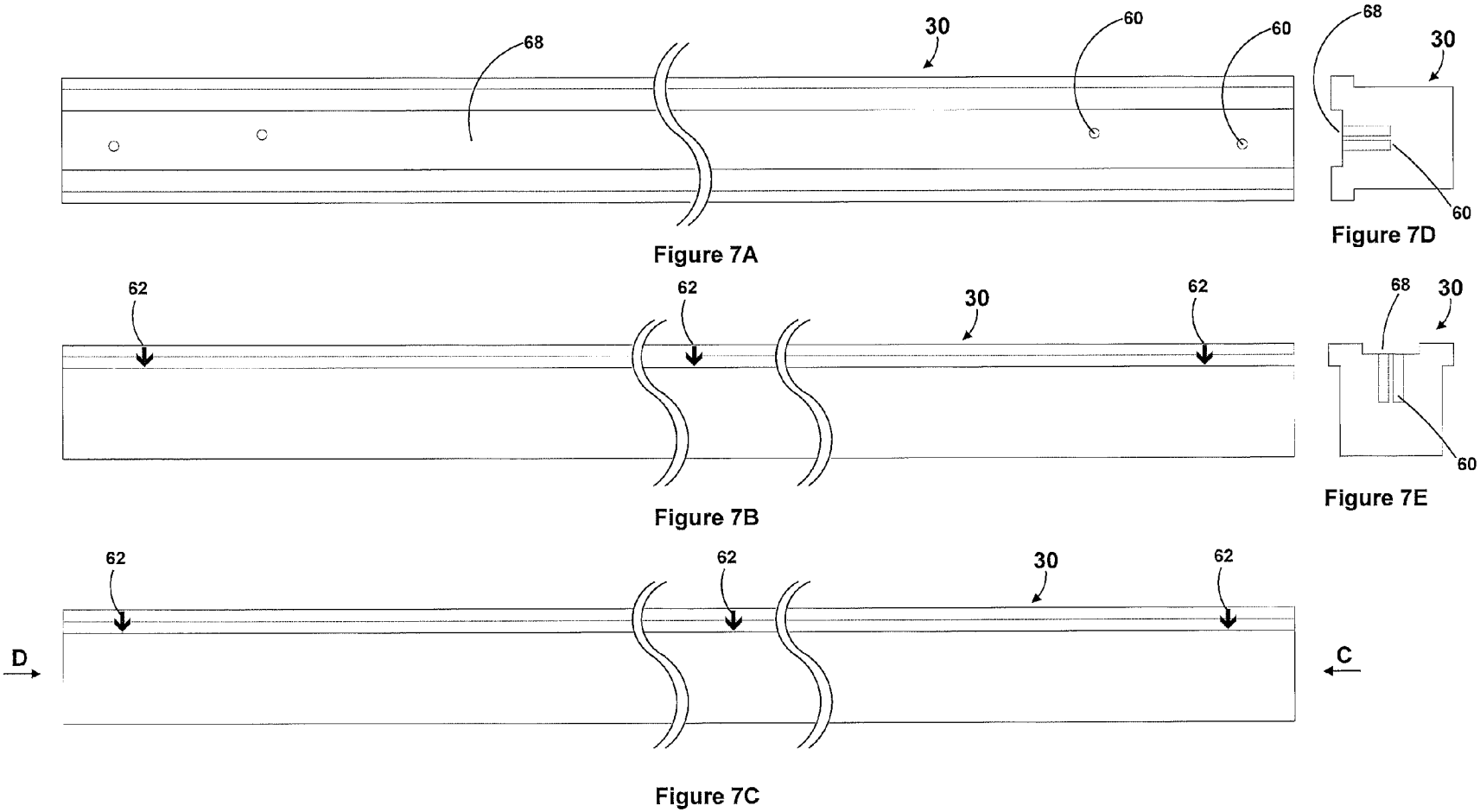
FIG. 7A is an interior top/bottom view of a top/bottom rail of the mounting platform shown in FIG. 1.
FIG. 7B is a front side view of a top/bottom rail of the mounting platform shown in FIG. 1.
FIG. 7C is a back side view of a top/bottom rail of the mounting platform shown in FIG. 1.
FIG. 7D is an end side view of a top/bottom rail of the mounting platform shown from the direction shown by directional arrow C in FIG. 7C.
FIG. 7E is an end side view of a top/bottom rail of the mounting platform shown from the direction shown by directional arrow D in FIG. 7C.
Figure 8:
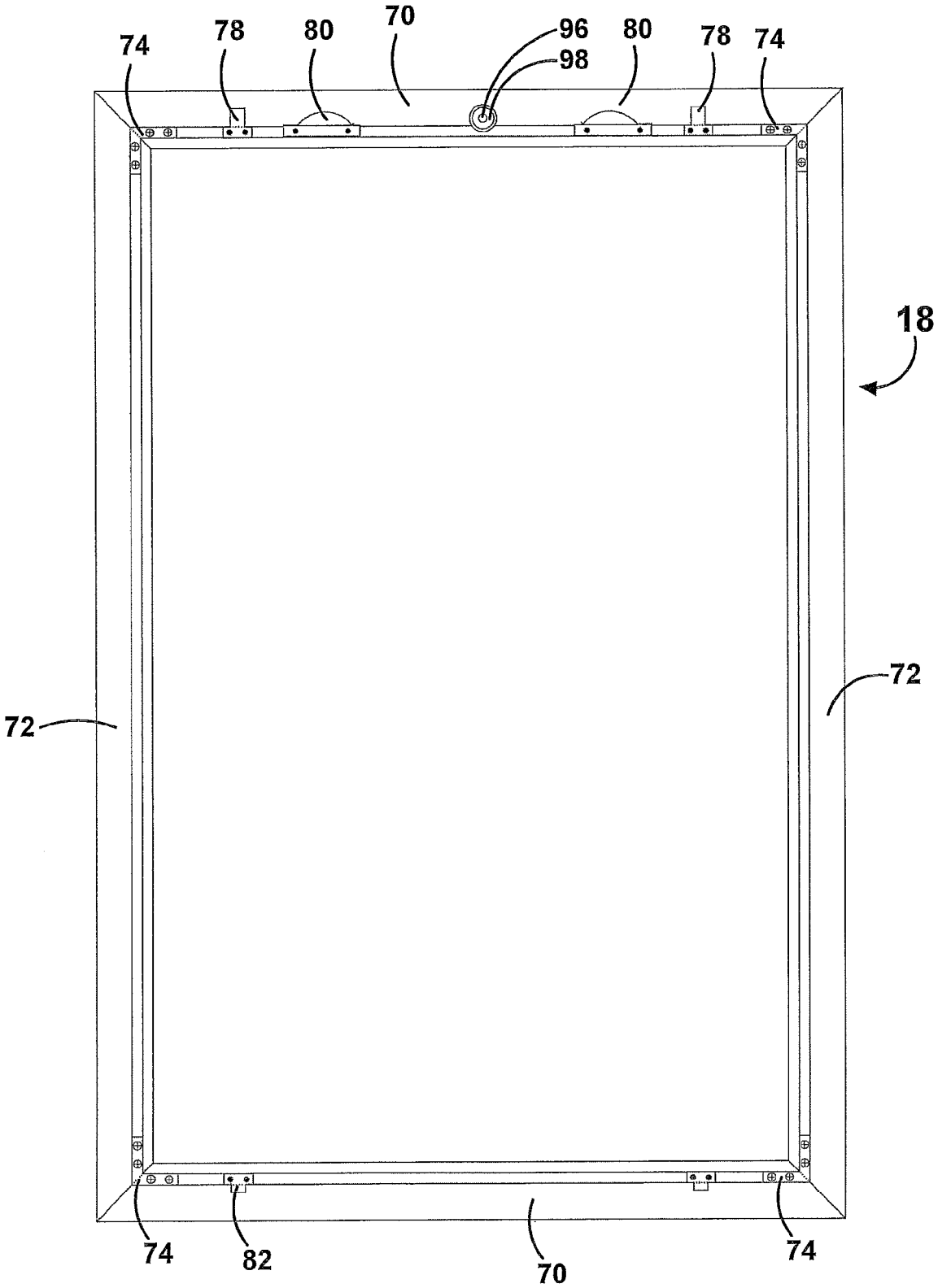
FIG. 8 is back view of the modular insert retaining housing frame shown in FIG. 1.

The present invention is directed to an insert holding system, a kit, and a method of installing the same.

Referring to FIGS. 1-23, there is a shown insert holding system 10, a kit 10 and a method of installing the same, the method being shown particularly in FIGS. 19-23. The insert holding system 10 includes a modular insert housing frame 12, a mounting platform 14, an insert 16, and a modular insert retaining housing frame 18. The modular insert housing frame 12 includes an upper left segment 20, an upper right segment 22, a lower left segment 24, and a lower right segment 26. These segments are configured for attachment to the mounting platform 14, which includes side rails 28, and top/bottom rails 30. The modular insert housing frame 12 can also be directly installed into a properly cut opening in a solid core door as detailed below.

Referring more particularly to FIGS. 2A-5E, details of the modular insert housing frame 12 are shown. The upper left segment 20, the upper right segment 22, the lower left segment 24, and the lower right segment 26 include a plurality of predrilled holes 32 for fastening the segments to a decorative base frame, and a plurality of predrilled holes 34 for fastening the segments to the mounting platform 14. The upper left segment 20 and the upper right segment 22 include upper cutouts 36 for receiving metal strips 38 to form upper slots 40. The upper left segment 20 and the upper right segment 22 also include cutouts 42 for receiving rotatable tabs 44. The cutouts 42 for receiving rotatable tabs 44 also include predrilled hole 46 for securing rotatable tabs 44. The rotatable tabs 44 are complementing safety devices that aid a user by ensuring that the insert remains in place during the removal and installation of the modular insert retaining housing frame 18 by preventing gravity induced forward tilting movement when the rotatable tabs 44 are engaged. The lower left segment 24, and the lower right segment 26 include lower cutouts 48 for receiving metal strips 38 to form lower slots 50. The upper left segment 20, the upper right segment 22, the lower left segment 24, and the lower right segment 26 include sizing portions 52, which can be removed to adjust the size of the insert housing frame 12. The sizing portions 52 may be partially precut or only marked with indicia to aid an installer in adjusting the size of the insert housing frame 12.

Referring more particularly to FIGS. 6A-6F, details of the side rails 28 of the mounting platform 14 are shown. The side rails 28 include an indented side seat 54 for the brackets 56 that secure the side rails 28 and top/bottom rails 30 together when installed in a hollow core door 58. The side rails 28 also include predrilled screw holes 60 for attachment of the brackets 56. Indicia arrows 62 indicate where nails 64 should be positioned and nailed when installing the side rails 28 into hollow core door 58. The side rails 28 may also have a door knob cutout 66 to accommodate material reinforcing the area around the doorknob or hole for a doorknob of a hollow core door 58.

Referring more particularly to FIGS. 7A-7E, details of the top/bottom rails 30 of the mounting platform 14 are shown. The top/bottom rails 30 include an indented top/bottom seat 68 for the brackets 56 that secure the side rails 28 and top/bottom rails 30 together when installed in a hollow core door 58. The top/bottom rails 30 also include predrilled screw holes 60 for attachment of the brackets 56. Indicia arrows 62 indicate where nails 64 should be positioned and nailed when installing the top/bottom rails 30 into hollow core door 58.

Figure 9:
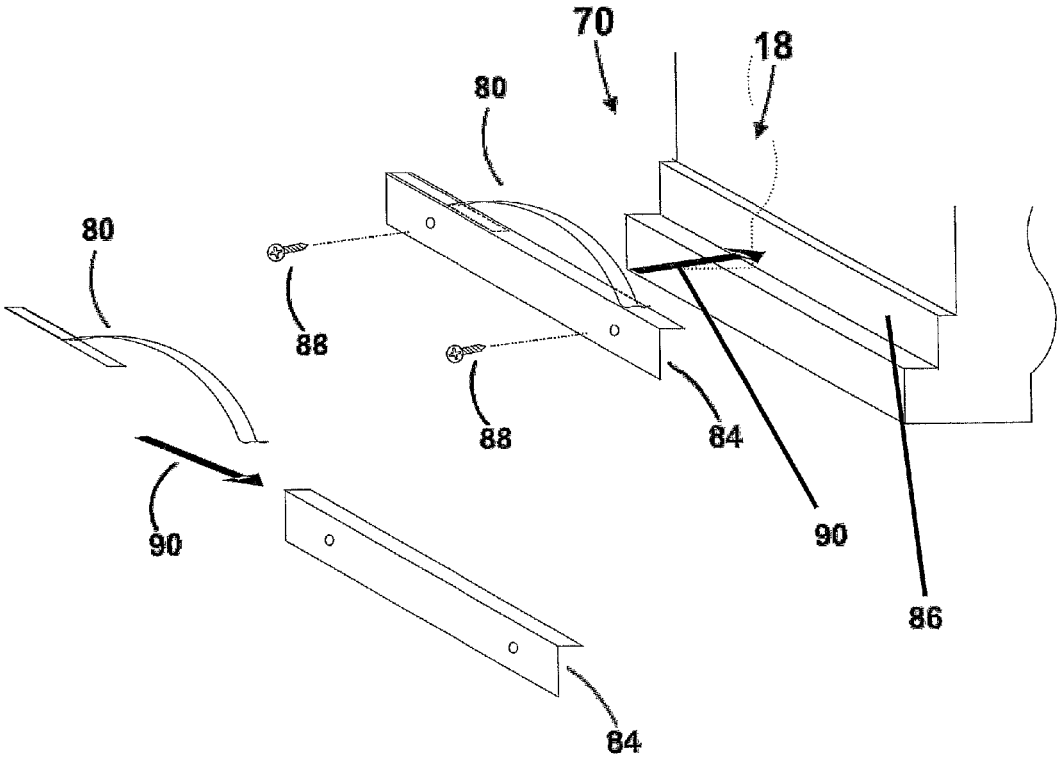
FIG. 9 is an exploded view of a spring of the modular insert retaining housing frame shown in FIG. 8.
Figure 10:
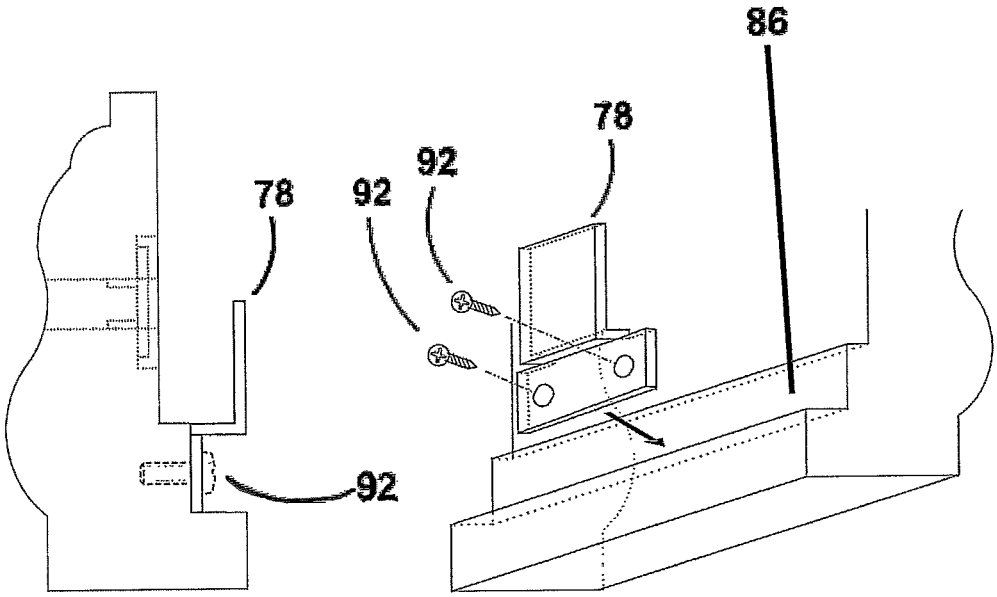
FIG. 10 is close up views of an upper tab of the modular insert retaining housing frame shown in FIG. 8.
Figure 11:
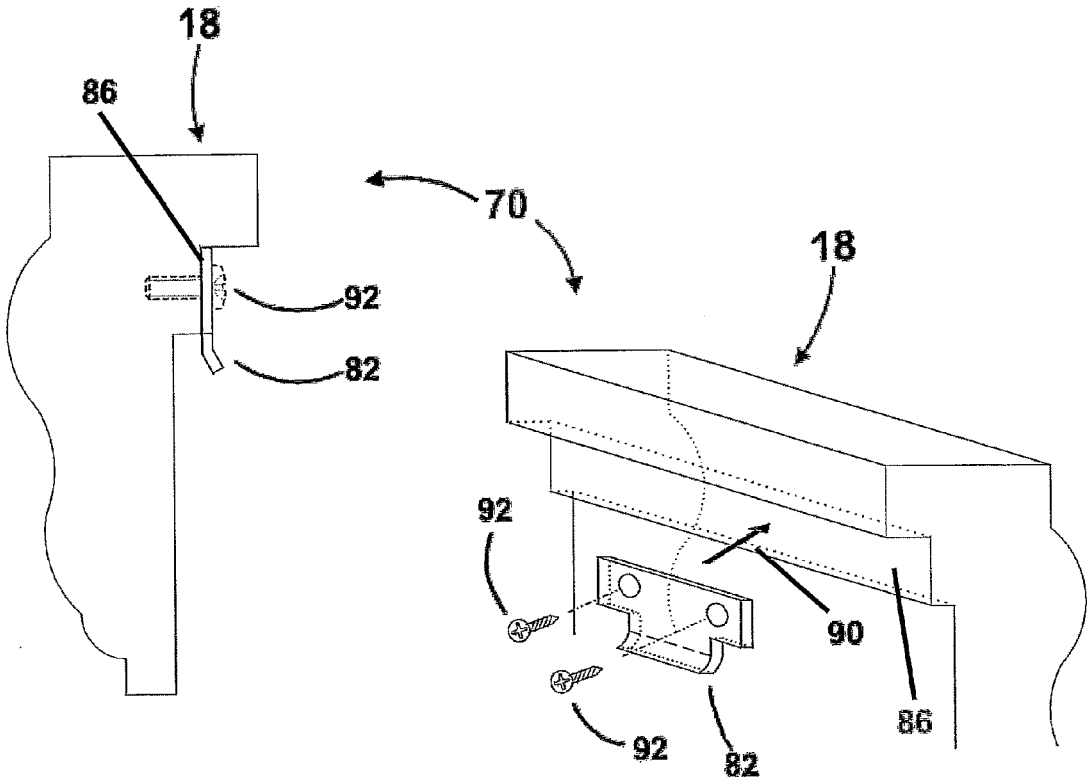
FIG. 11 is close up views of a lower tab of the modular insert retaining housing frame shown in FIG. 8.
Figure 12:
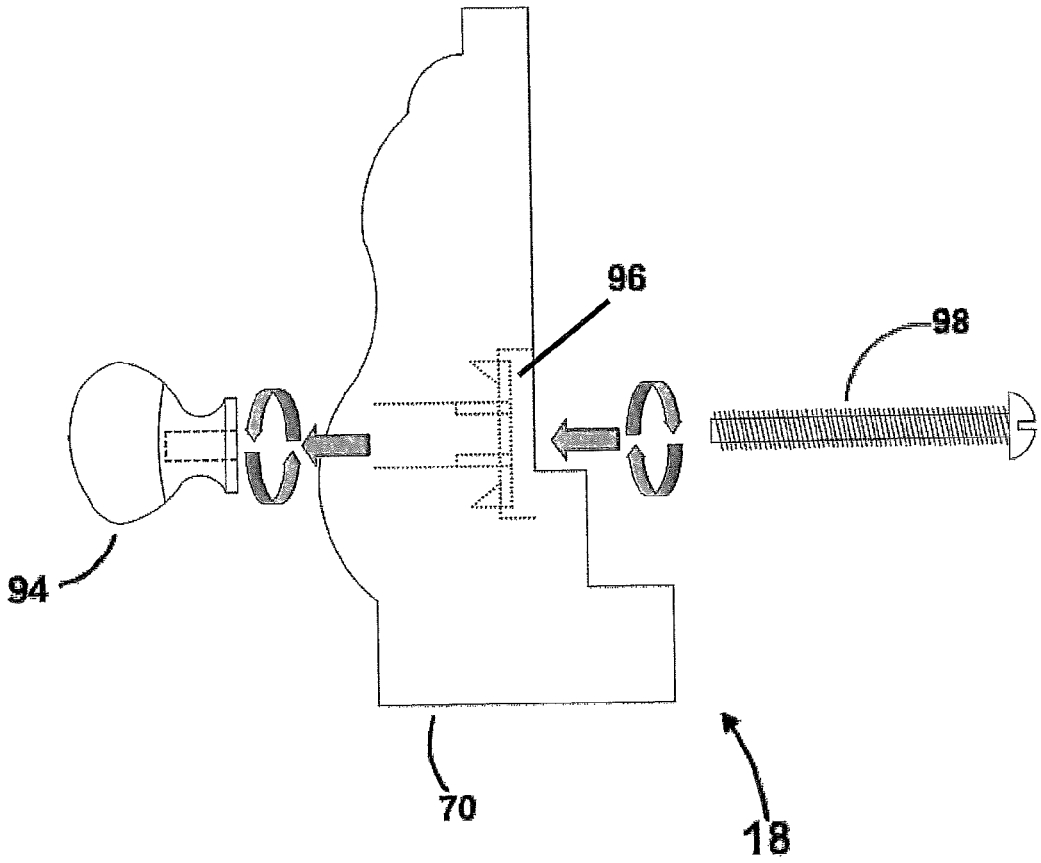
FIG. 12 is an illustration of the installation of the knob of the modular insert retaining housing frame shown in FIG. 8.
Figure 13A:
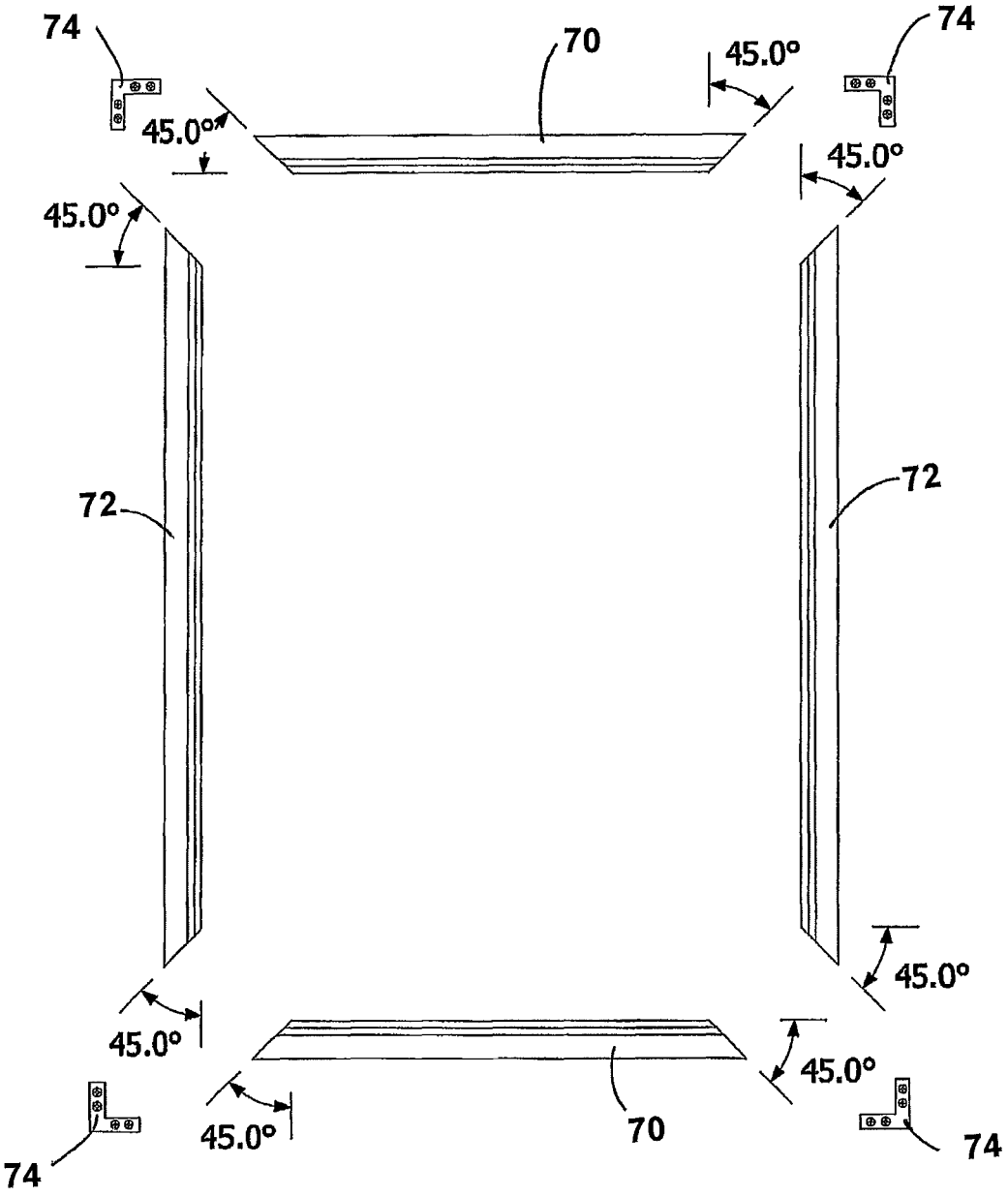
FIG. 13A is a back view of the segments of modular insert retaining housing frame shown in FIG. 8.
Figure 13C:
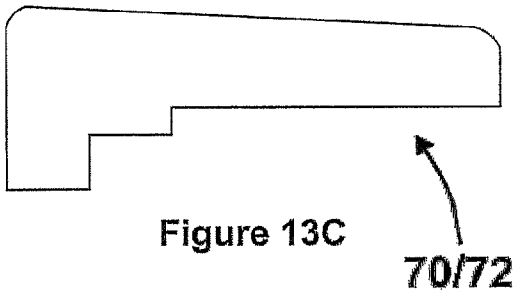
FIG. 13C is a side view of the profile of a segment of modular insert retaining housing frame shown in FIG. 8.
Figure 13B:
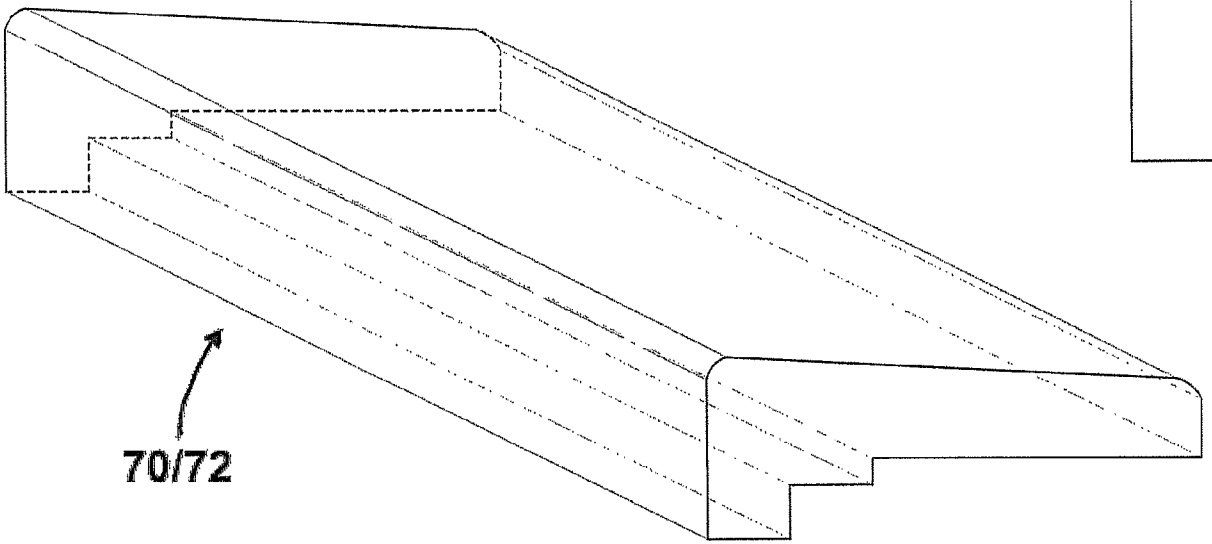
FIG. 13B is a perspective view of the profile of a segment of modular insert retaining housing frame shown in FIG. 8.

Referring more particularly to FIGS. 8-13C, details of the modular insert retaining housing frame 18 are shown. The modular insert retaining housing frame 18 includes upper/lower frame segments 70, and side frame segments 72, which are secured together via frame brackets 74 and frame screws 76. Frame cornering nails may be used as a substitution for securing the frame corners together. The modular insert retaining housing frame 18 further includes metal upper tabs 78, flat springs 80, and metal lower tabs 82. Referring particularly to FIG. 9, the flat spring 80 is secured to the spring bracket 84, and then secured to a lip 86 of the modular insert retaining housing frame 18 via spring screws 88 as illustrated by directional arrows 90. Now referring particularly to FIG. 10, upper tab 78 is secured to a lip 86 of the modular insert retaining housing frame 18 via tab screws 92 as illustrated by directional arrows 90. Now referring particularly to FIG. 11, lower tab 82 is secured to a lip 86 of the modular insert retaining housing frame 18 via tab screws 92 as illustrated by directional arrows 90. Referring more particularly to FIG. 12, a brass knob 94 may be secured to the modular insert retaining housing frame 18 via tee nut 96 and machine screw 98. The knob 94 is a complementing safety device that aids a user in ensuring that the modular insert retaining housing frame 18 remains seated in the insert housing frame 12 by preventing upward movement when engaged, which is detailed further below.

Figure 14A:
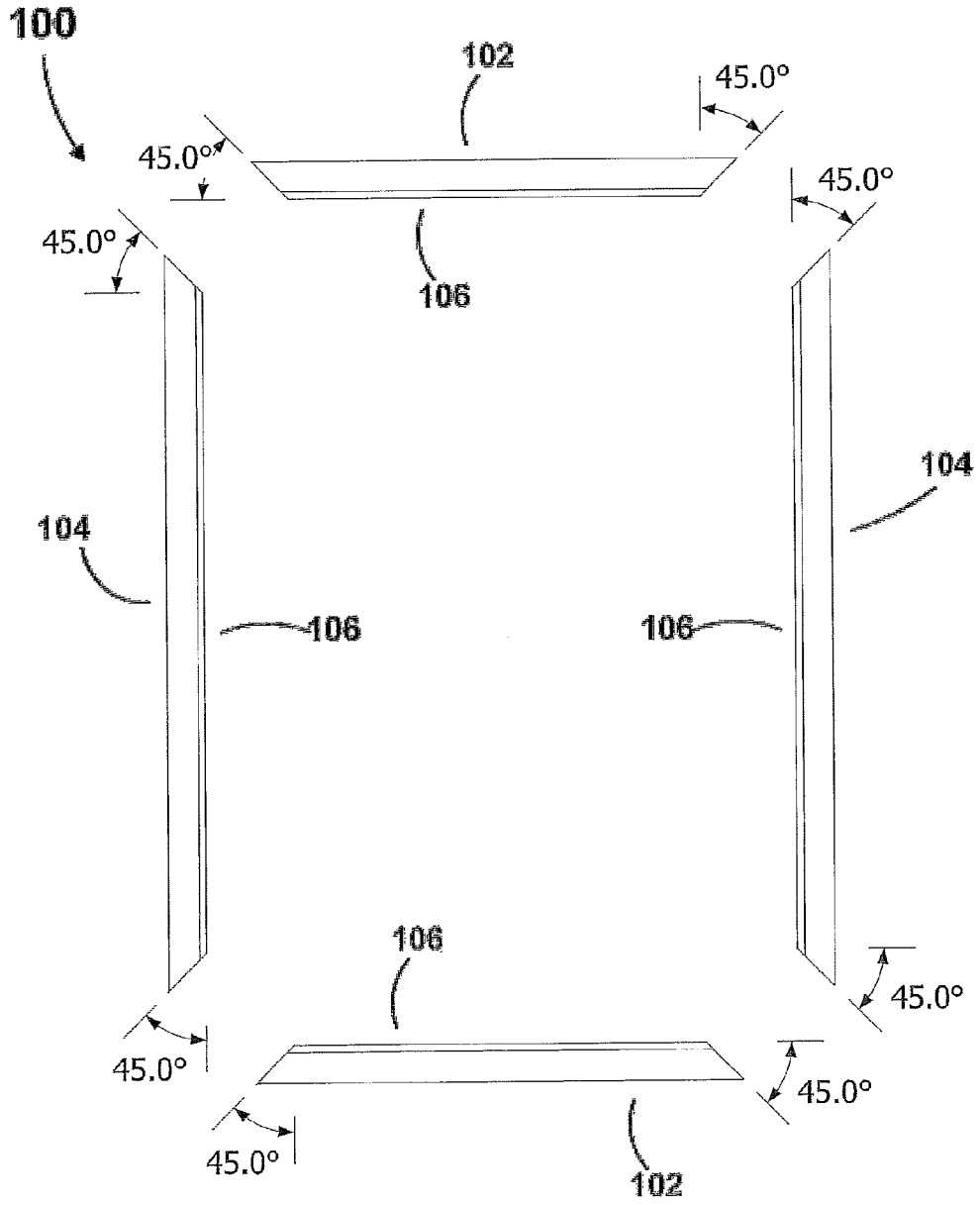
FIG. 14A is a back view of the segments of modular insert housing frame shown in FIG. 1.
Figure 14C:
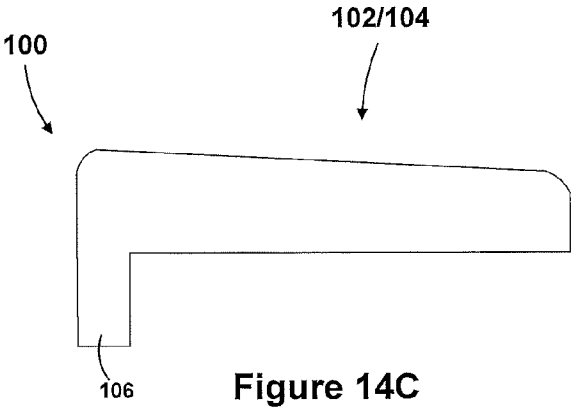
FIG. 14C is a side view of the profile of a segment of modular insert housing frame shown in FIG. 1.
Figure 14B:
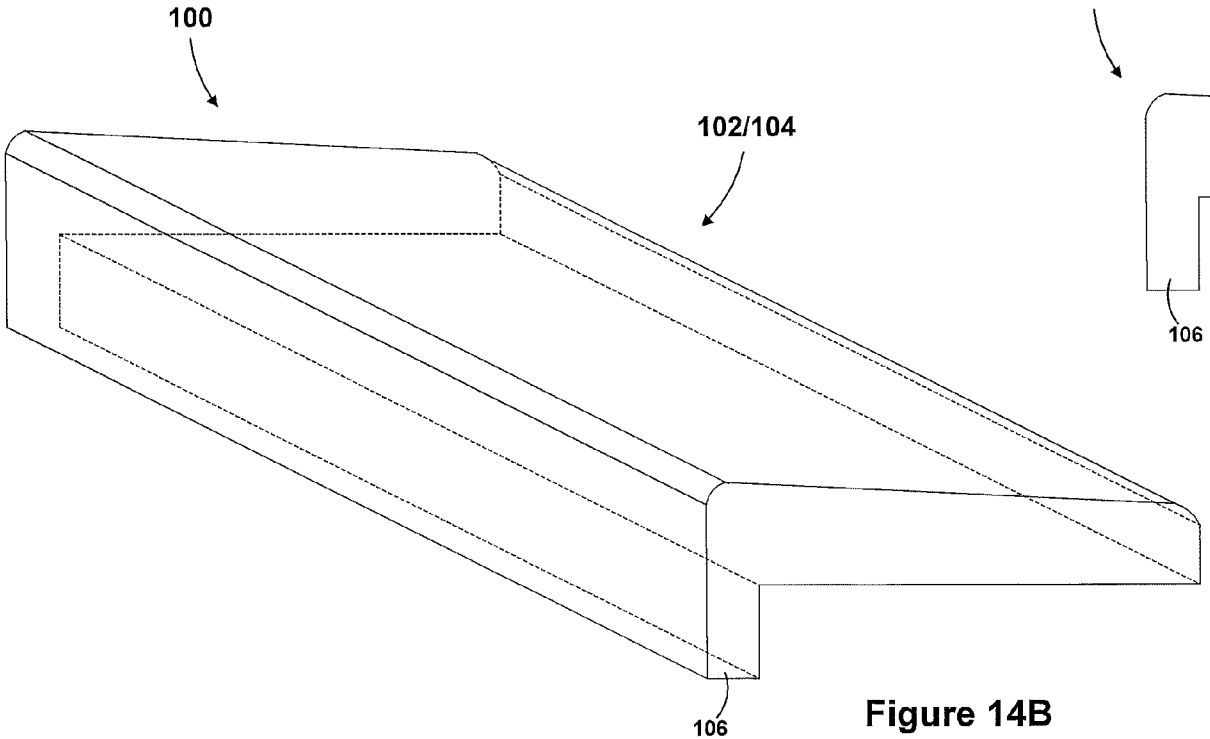
FIG. 14B is a perspective view of the profile of a segment of modular insert housing frame shown in FIG. 1.

Referring more particularly to FIGS. 14A-14C, the decorative base frame 100 of the modular insert housing frame 12 includes top/bottom frame segments 102 and side frame segments 104. The top/bottom frame segments 102 and side frame segments 104 each include an attachment ridge 106 for lining up the attachment to the upper left segment 20, the upper right segment 22, the lower left segment 24, and the lower right segment 26 of the modular insert housing frame 12. While decorative base frame 100 does improve the aesthetics of the modular insert housing frame 12, the decorative base frame 100 also serves to attach the upper left segment 20, the upper right segment 22, the lower left segment 24, and the lower right segment 26 together via screw holes 32 when these elements are screwed together.

Figures 15A, 15B:
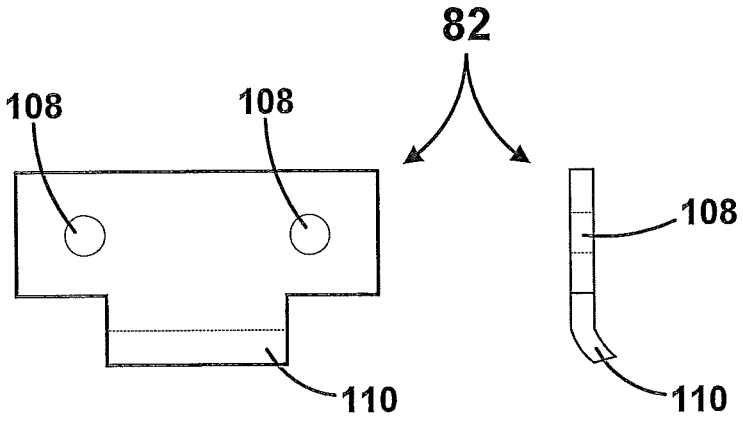
FIG. 15A is a close up front view of a lower tab of the modular insert retaining housing frame shown in FIG. 8.
FIG. 15B is a close up side view of a lower tab of the modular insert retaining housing frame shown in FIG. 8.

Referring more particularly to FIGS. 15A and 15B, lower tab 82 includes holes 108 for receiving tab screws 92 and a curved projection 110 configured to be received in lower slots 50.

Figures 16A, 16B:
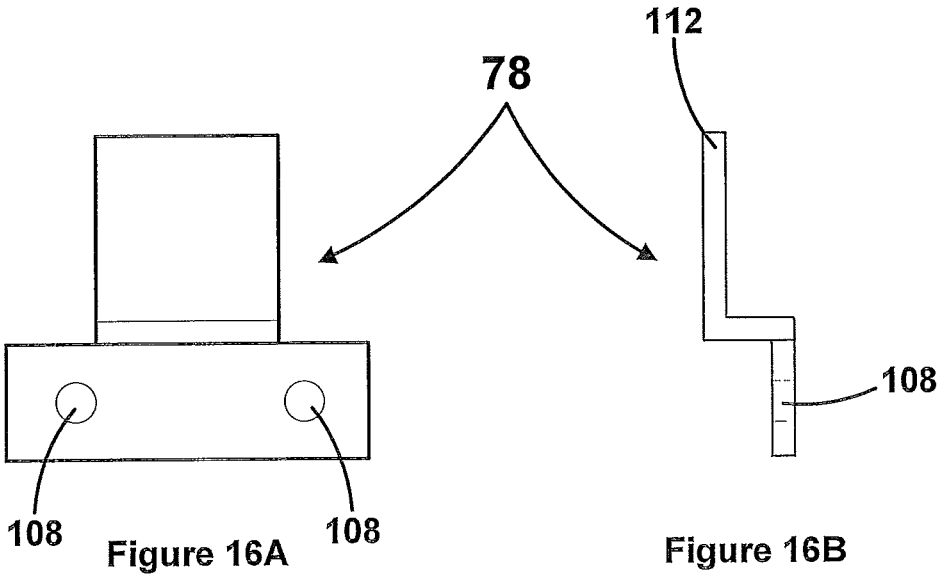
FIG. 16A is a close up front view of an upper tab of the modular insert retaining housing frame shown in FIG. 8.
FIG. 16B is a close up side view of an upper tab of the modular insert retaining housing frame shown in FIG. 8.

Referring more particularly to FIGS. 16A and 16B, upper tab 78 includes holes 108 for receiving tab screws 92 and a planar projection 112 configured to be received in upper slots 40.

Referring more particularly to FIGS. 17A-17E, while the above detailed description shows a particular embodiment, for implementing the present invention, there are other ways to the practice the present invention. The specific implementation chosen can be determined by the desired manufacturing methods and materials used.

Figure 17A:
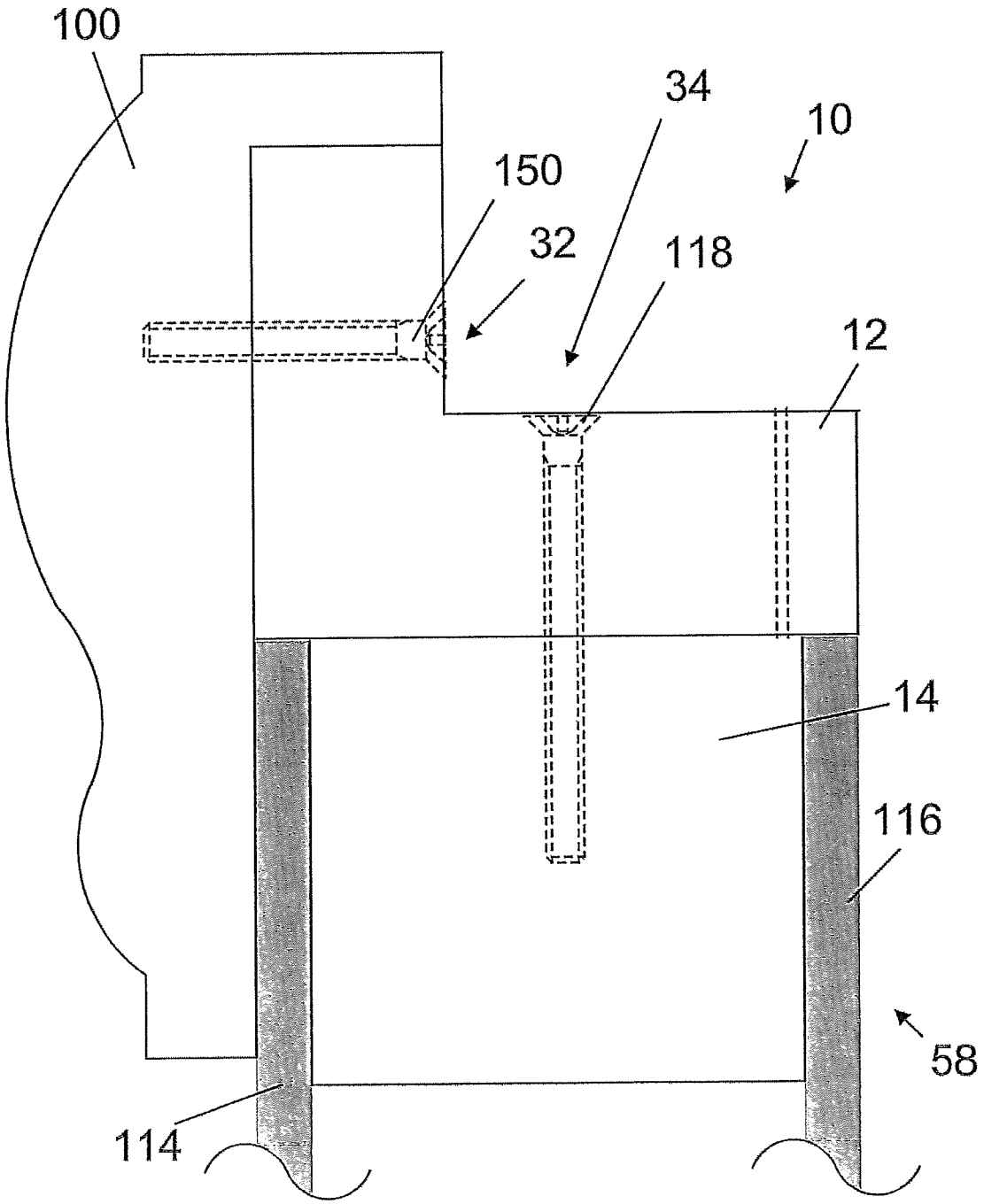
FIG. 17A is an illustration of an installation method of the insert holding system during manufacturing of a hollow core door in accordance with the present invention.

Referring particularly to FIG. 17A, the insert holding system 10 can be constructed in a hollow core door 58 during manufacturing of the door. In this embodiment, the mounting platform 14 is disposed between the first skin 114 and second skin 116 of the hollow core door 58. The modular insert housing frame 12 with attached decorative base frame 100 is secured to the mounting platform 14 via predrilled holes 34 and attachment screw 118.

Figure 17B:
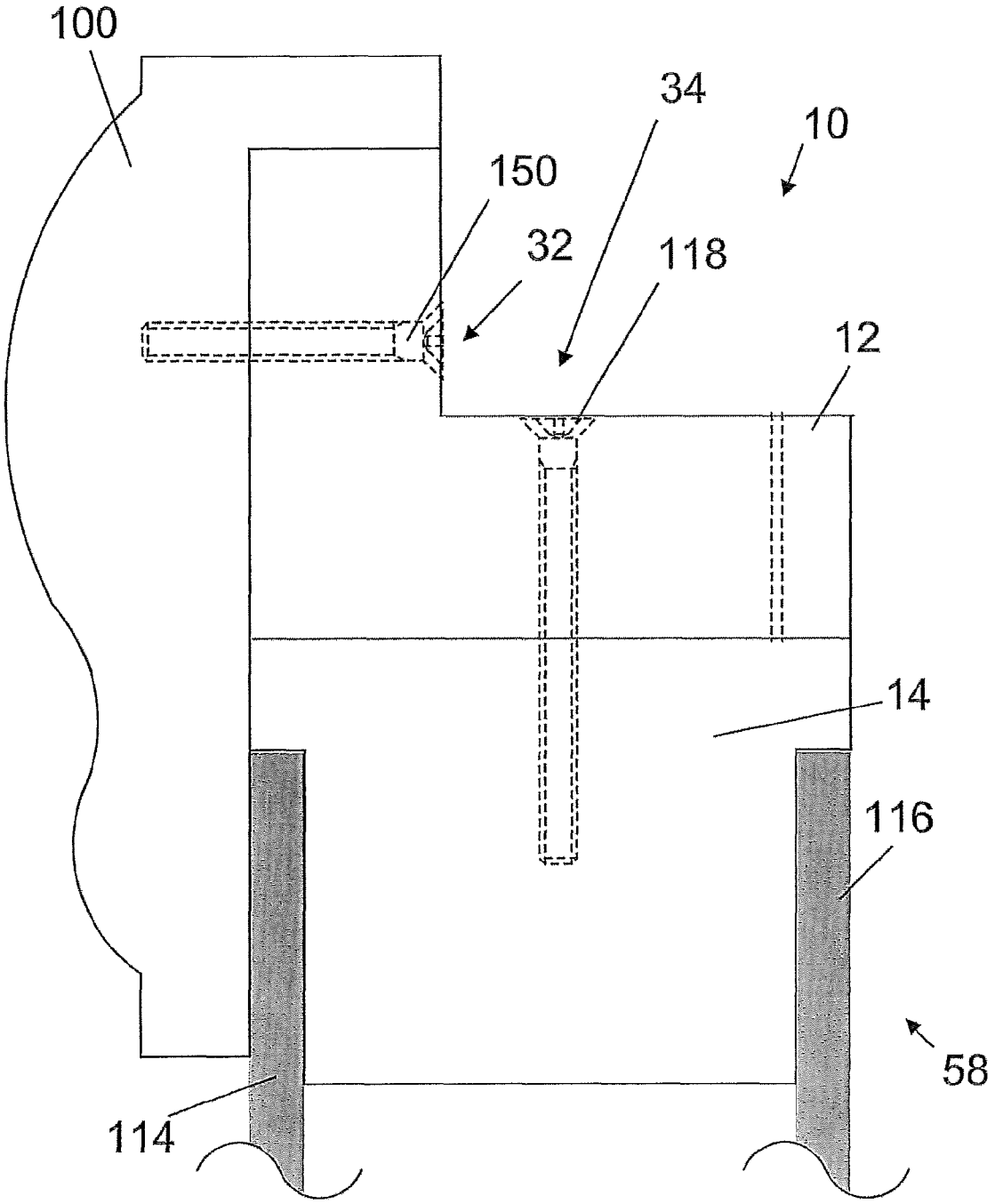
FIG. 17B is an illustration of an installation method of the insert holding system after manufacturing of a hollow core door in accordance with the present invention.

Referring particularly to FIG. 17B, the insert holding system 10 can be constructed in a hollow core door 58 after manufacturing of the door. In this embodiment, the mounting platform 14 is disposed between the first skin 114 and second skin 116 of the hollow core door 58. The modular insert housing frame 12 with attached decorative base frame 100 is secured to the mounting platform 14 via predrilled holes 34 and attachment screw 118.

Figure 17C:
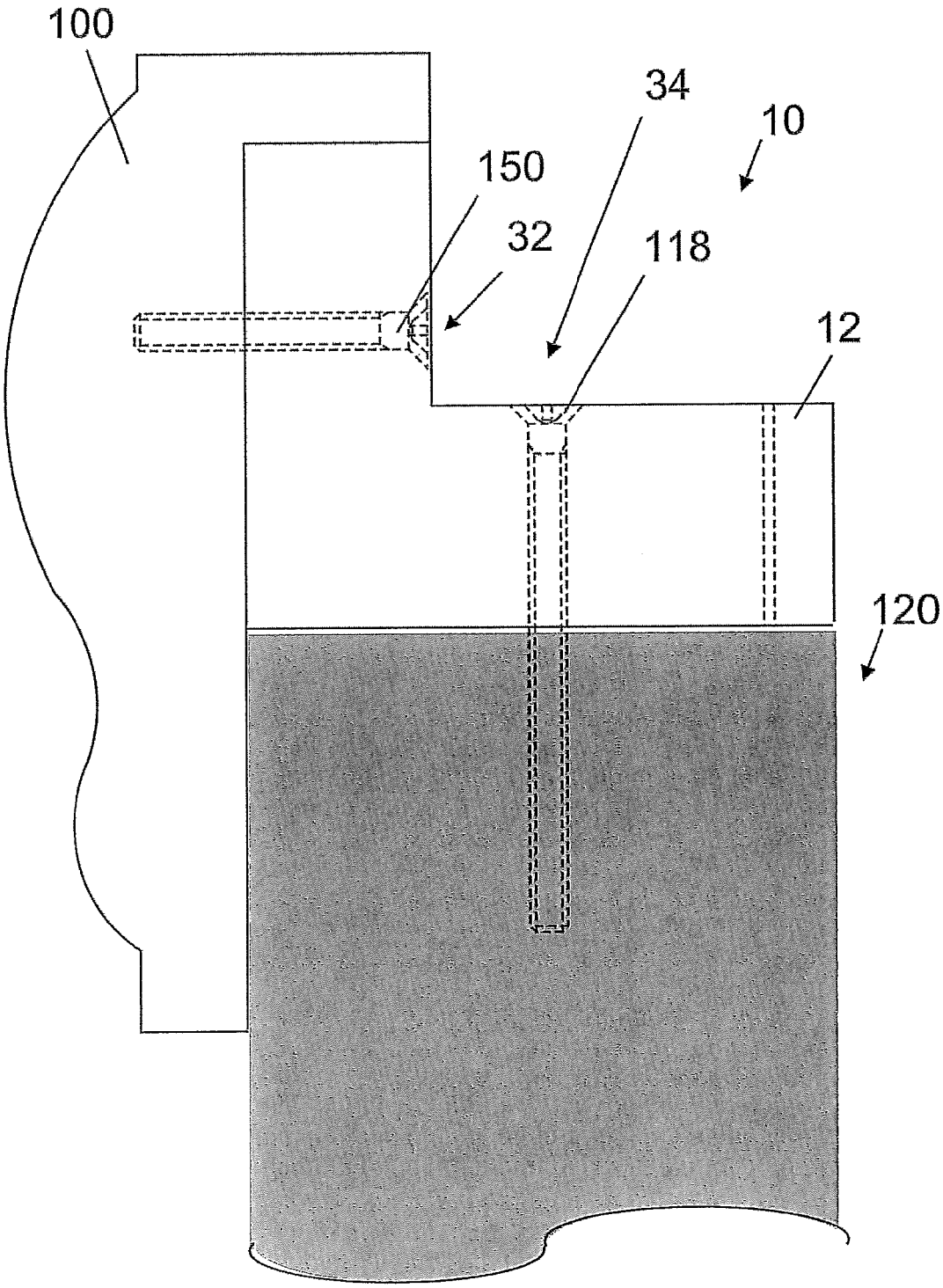
FIG. 17C is an illustration of an installation method of the insert holding system in a solid core door in accordance with the present invention.

Referring particularly to FIG. 17C, the insert holding system 10 can be constructed in a solid core door 120 during or after manufacturing of the solid core door 120. In this embodiment, no mounting platform is needed since the modular insert housing frame 12 with attached decorative base frame 100 is secured to solid core door 120 directly via predrilled holes 34 and attachment screw 118.

Figure 17D:
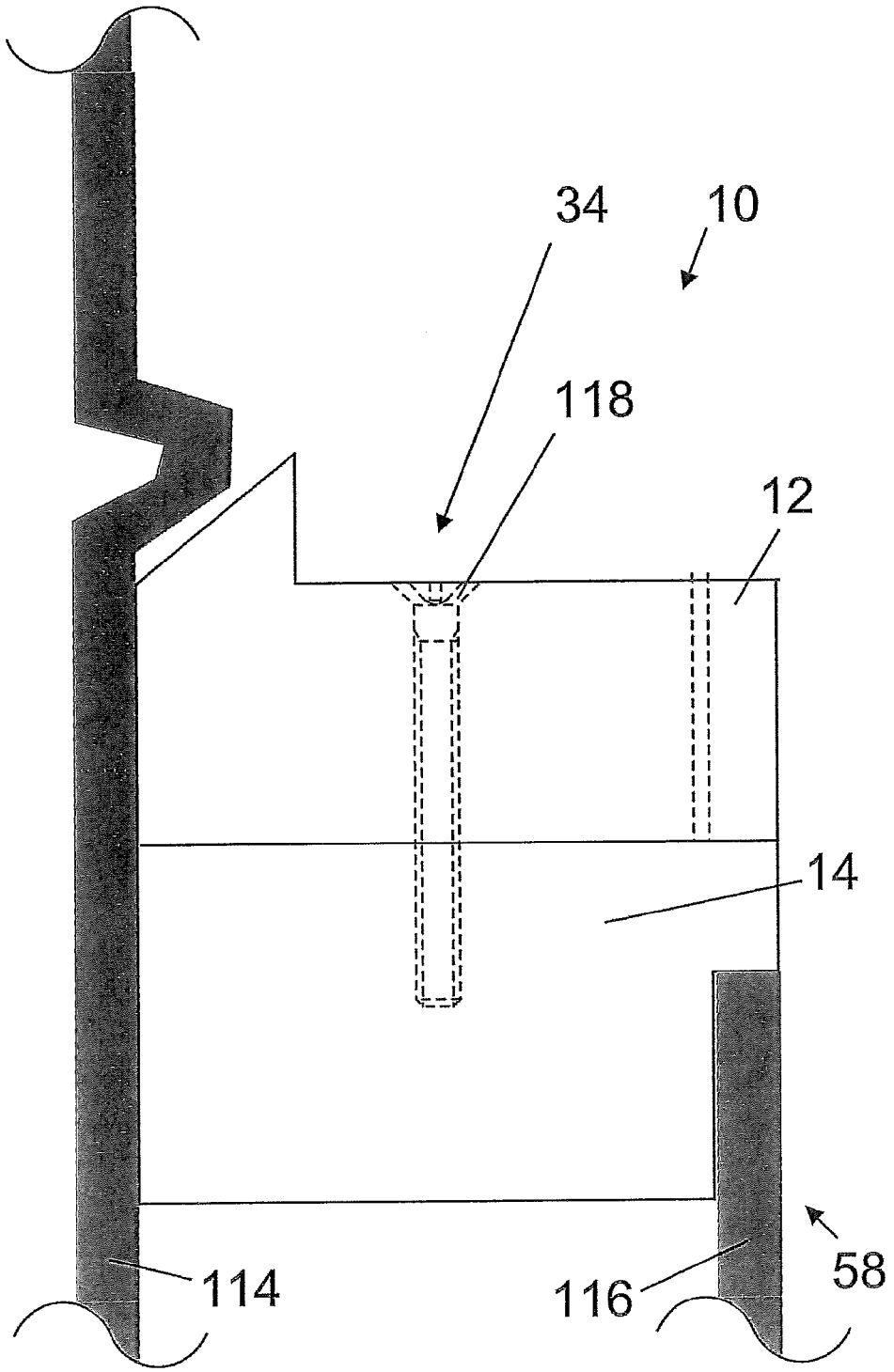
FIG. 17D is an illustration of an installation method of the insert holding system in a hollow core door with only one opening in accordance with the present invention.

Referring particularly to FIG. 17D, the insert holding system 10 can be installed in a hollow core door 58 so that there is only an opening through the second skin 116 of the hollow core door 58. In this embodiment, the mounting platform 14 is disposed between the first skin 114 and second skin 116 of the hollow core door 58. The modular insert housing frame 12 with attached decorative base frame 100 is secured to the mounting platform 14 via predrilled holes 34 and attachment screw 118.

Figure 17E:
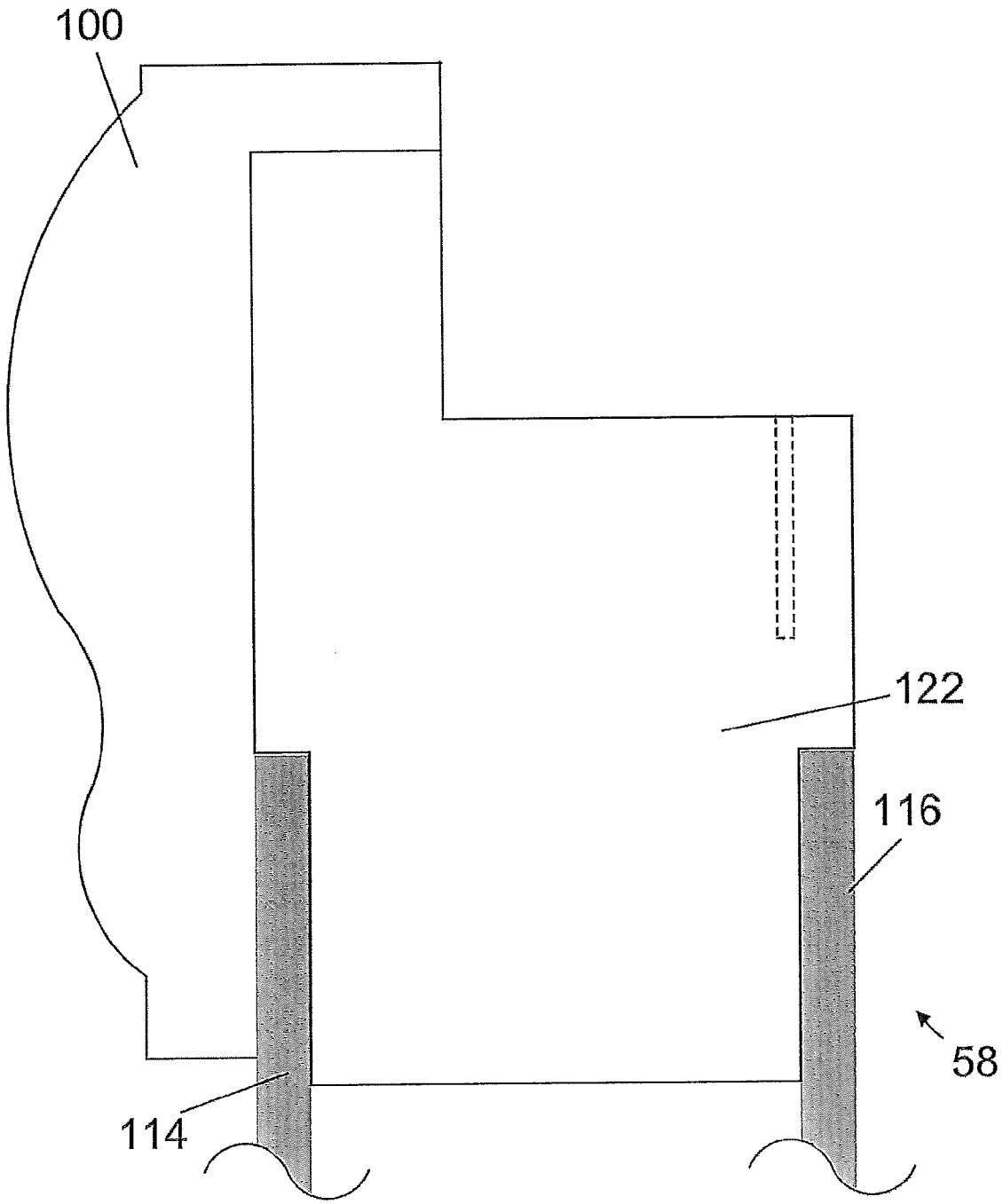
FIG. 17E is an illustration of an installation method of the insert holding system, where the mounting platform is integral with the modular insert housing frame, in a hollow core door in accordance with the present invention.

Referring particularly to FIG. 17E, the insert holding system 10 can be constructed in a hollow core door 58 so that the mounting platform 14 and modular insert housing frame 18 are combined to form an integrated platform 122. In this embodiment, the integrated platform 122 is disposed between the first skin 114 and second skin 116 of the hollow core door 58. The integrated platform 122 with attached decorative base frame 100 is secured directly to the first skin 114 and second skin 116 of the hollow core door 58 via nails, glue, or another fastener (not shown).

Figure 18B:
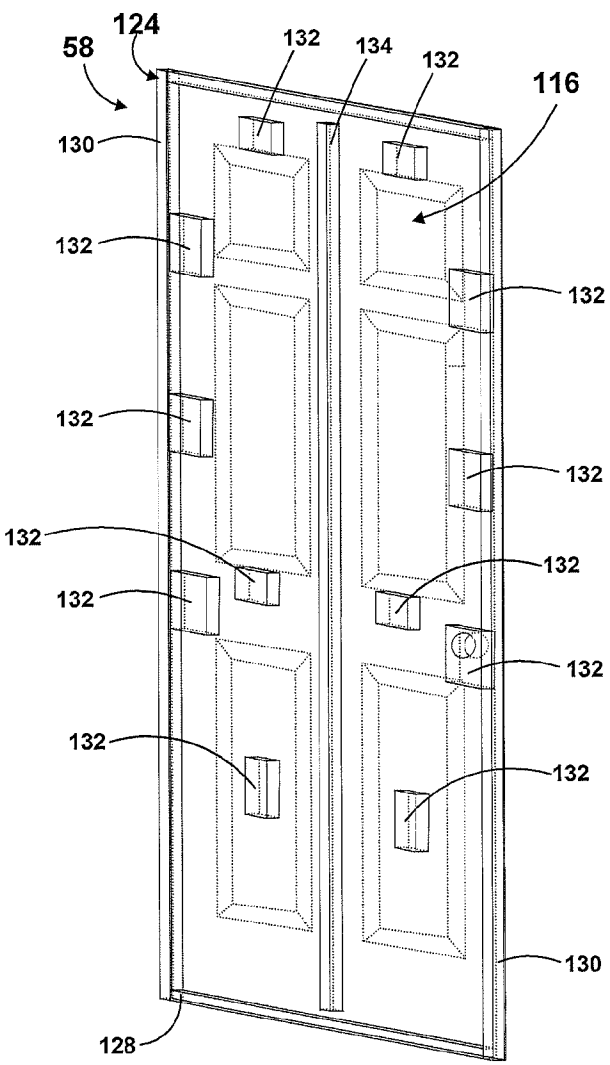
FIG. 18B is an illustration of another hollow core door that is constructed to accept an insert holding system made in accordance with the present invention.
Figure 18A:
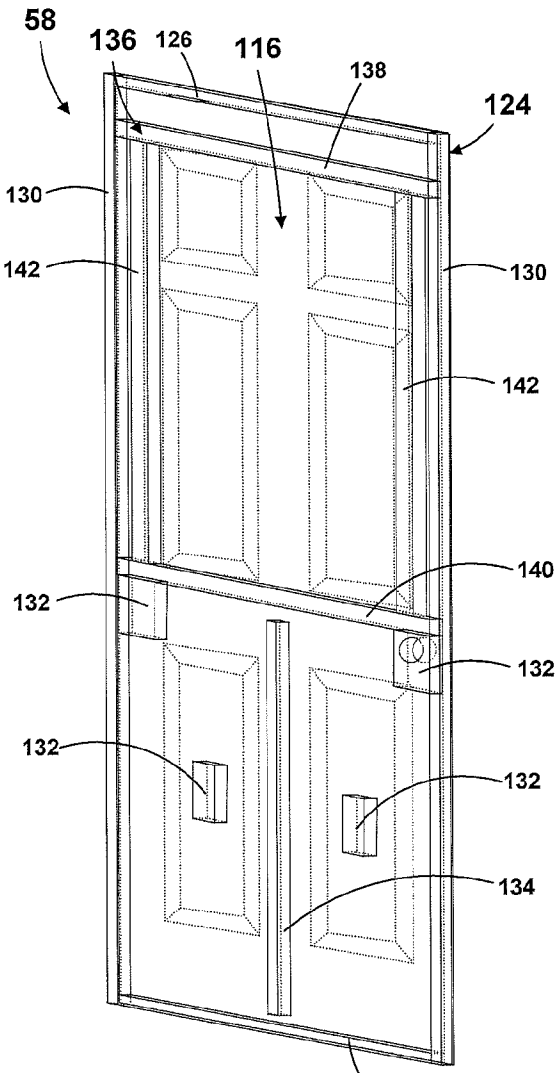
FIG. 18A is an illustration of a hollow core door that is constructed to accept an insert holding system made in accordance with the present invention.

Referring particularly to FIGS. 18A and 18B, the insert holding system 10 can be installed in either of the hollow core doors shown in FIGS. 18A and 18B. The hollow core door 58 is shown with the first skin 114 removed to show the structure inside the hollow core door 58. This door 58 includes a peripheral frame 124 which includes a top member 126, a bottom member 128 and side members 130. The door 58 further includes support blocks 132 and spine 134 to strengthen the door 58 and to make it more durable. The door 58 in FIG. 18A, also has an inner peripheral frame 136 which includes a top inner member 138, a bottom inner member 140, and side inner members 142. The mounting platform 14 of the insert holding system 10 is configured to attach to the above internal structures of a hollow core door 58 in addition to other typical arrangements known in the hollow core door arts.

Figure 19:
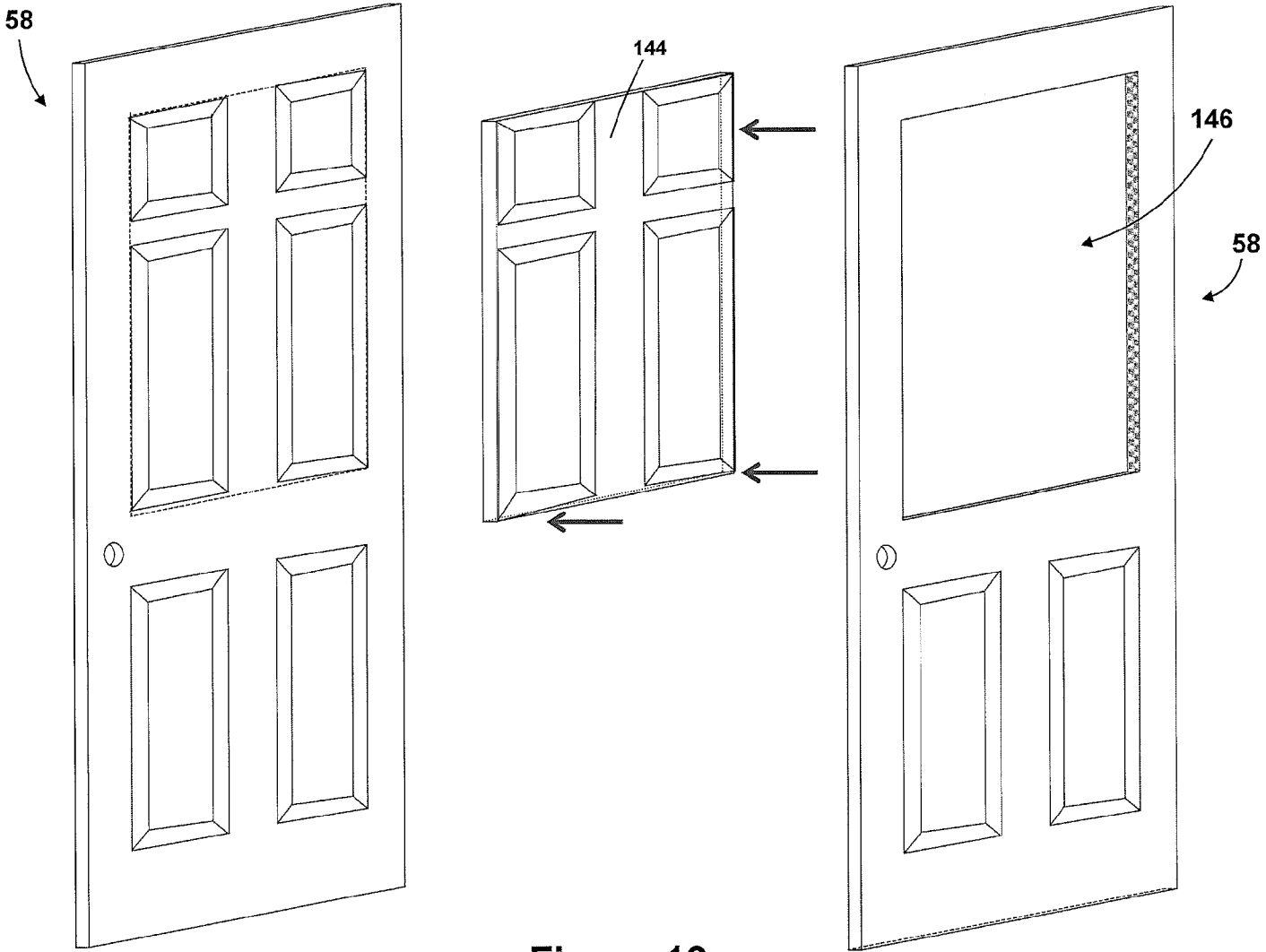
FIG. 19 is an illustration of the steps of cutting and removing a section of a hollow core door in accordance with the present invention.
Figure 20:
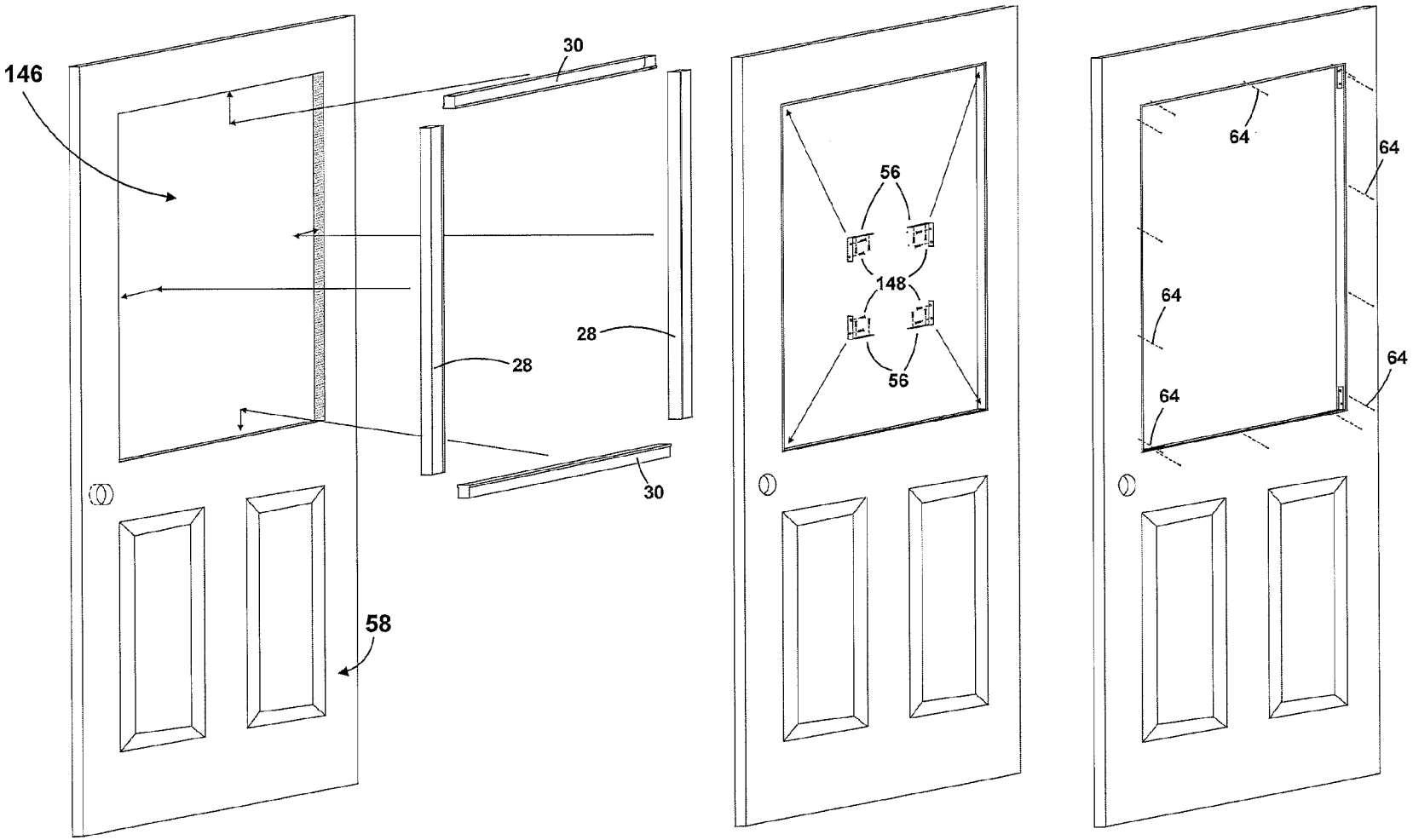
FIG. 20 is an illustration of the steps of installing a mounting platform in a hollow core door in accordance with the present invention.

Referring more particularly to FIGS. 19-23, a method of installing insert holding system 10, or the insert holding system kit 10, is illustrated. Referring to FIG. 19, a hollow core door 58 is provided, then a section 144 of the hollow core door 58 is cut and removed forming a through opening 146 in the hollow core door 58. Now referring to FIG. 20, the mounting platform 14, which includes side rails 28, and top/bottom rails 30 is positioned between the first skin 114 and second skin 116 of the hollow core door 58. The side rails 28 and top/bottom rails 30 should be placed serially in the door 58 one at a time in either a clockwise or counterclockwise order. Then the side rails 28 and top/bottom rails 30 are secured together via brackets 56 and bracket screws 148. Next, the mounting platform 14 is secured to the door 58 via nails 64.

Figure 21:
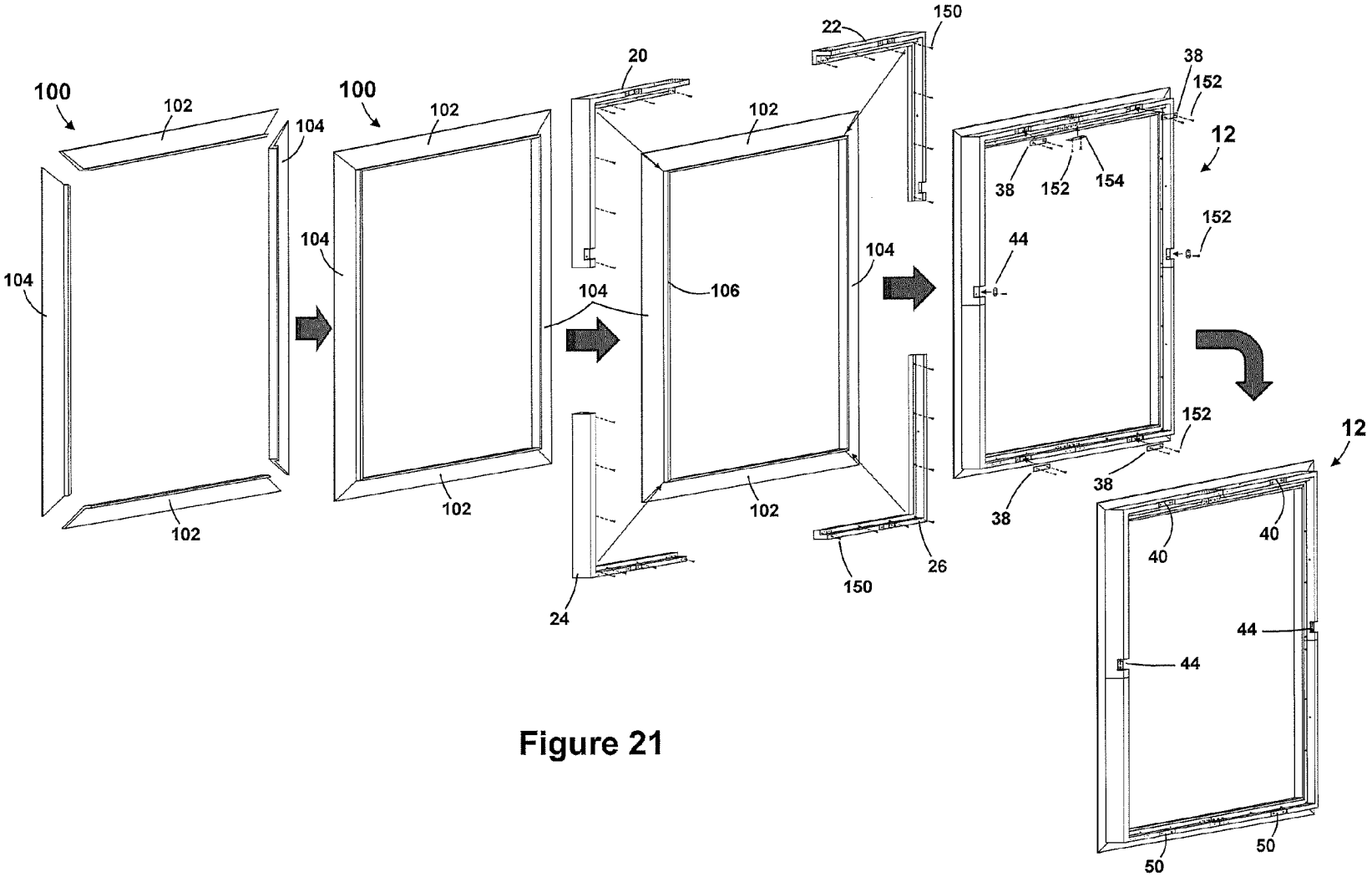
FIG. 21 is an illustration of the steps of assembling the modular insert housing frame shown in FIG. 1.

Now referring to FIG. 21 which shows the assembling of the modular insert housing frame 12. The top/bottom frame segments 102 and side frame segments 104 of the decorative frame 100 are positioned together then attached to the upper left segment 20, the upper right segment 22, the lower left segment 24, and the lower right segment 26 of the modular insert housing frame 12 via screw holes 32 and frame screws 150. The metal strips 38 are then secured to upper cutouts 36 via accessory screws 152 to form upper slots 40. Next the metal strips 38 are then secured to lower cutouts 48 via accessory screws 152 to form lower slots 50. Then rotatable tabs 44 are secured within cutouts 42 via predrilled hole 46 and accessory screws 152. The modular insert housing frame 12 may then be further reinforced by securing support bar 154 to the upper left segment 20 and the upper right segment 22 via accessory screws 152.

Figure 22:
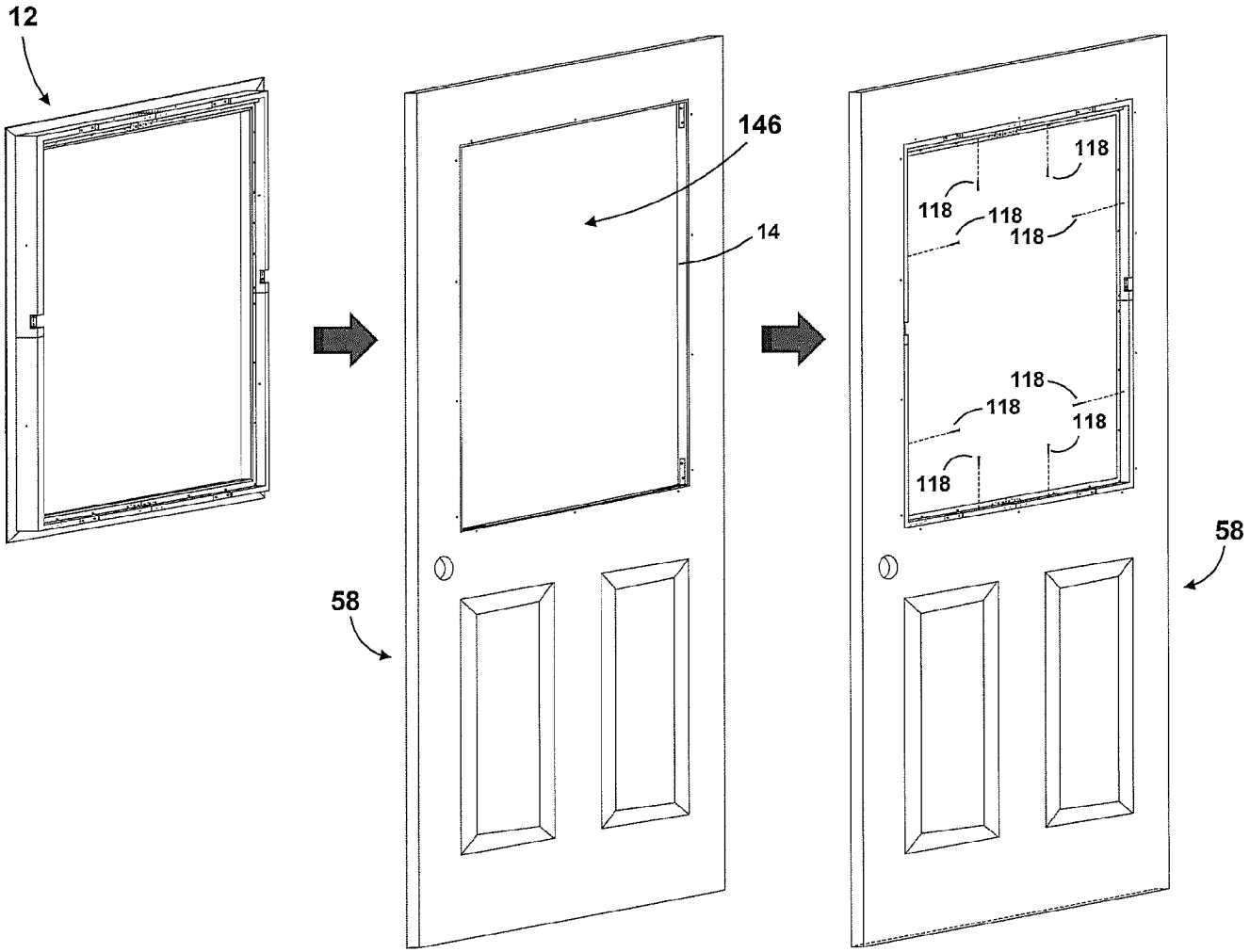
FIG. 22 is an illustration of the steps of installing the modular insert housing frame shown in FIG. 1 in the opening of the door shown in FIG. 19.

Now referring to FIG. 22, the modular insert housing frame 12 is then positioned in the through opening 146 and secured to the mounting platform 14 via attachment screws 118 being screwed through predrilled holes 34.

Figure 23:
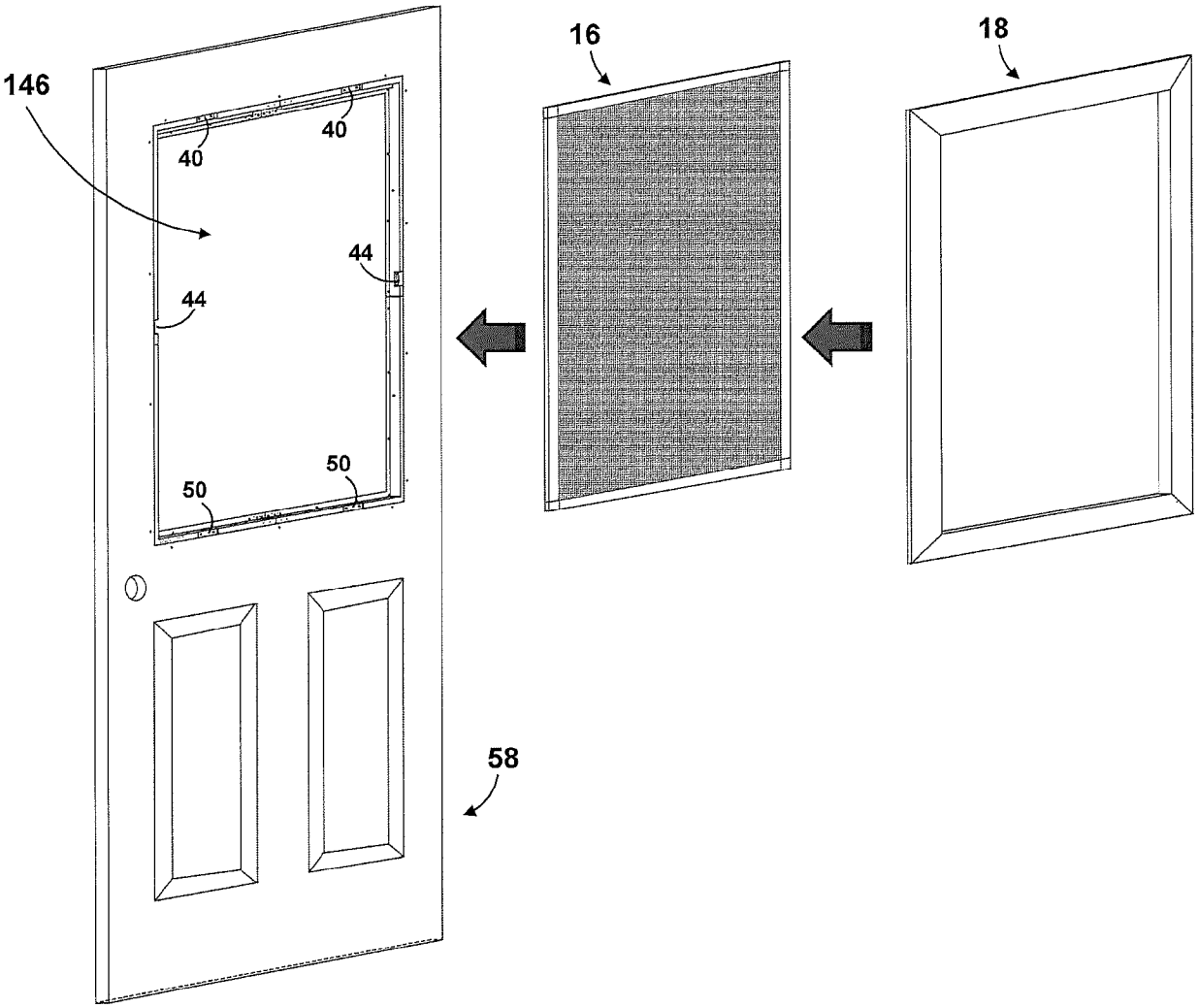
FIG. 23 is an illustration of the steps of installing the insert and modular insert retaining housing frame shown in FIG. 1.

Now referring to FIG. 23, the planar insert 16 can be placed within the chamber 156 defined by the modular insert housing frame 12. Then, rotatable tabs 44 can be moved to maintain the insert within the chamber 156, while a user obtains the modular insert retaining housing frame 18. The insert retaining housing frame 18 is coupled to the modular insert housing frame 12 without tools by sliding upper tabs 78 into upper slot 40 and by pushing up to compress springs 80. Then the bottom of the insert retaining housing frame 18 is swung towards the bottom of the modular insert housing frame 12 so that insert retaining housing frame 18 touches or applies pressure to the insert 16 and the lower tabs 82 are just above lower slots 50. The user then lets the modular insert retaining housing frame 18 slide down so that lower tabs 82 are received in lower slots 50, thereby securing the modular insert housing frame 12, the insert 16, and the insert retaining housing frame 18 are secured together. Similarly, the insert retaining housing frame 18 is removed from the modular insert housing frame 12 by sliding the insert retaining housing frame 18 up and swing the bottom of the insert retaining housing frame 18 out. Then moving the rotatable tabs 44 and removing the insert from the chamber 156.

The components of the insert holding system 10 and the insert holding system kit 10 can be constructed from any suitable material or combinations of materials. It is specifically envisioned that the above components are constructed from a plastic, a polymer, a wood, a fiber board, a particle board, a fiberglass, or any combination thereof. The above components can also be delivered to a user completely or partially assembled to aid in the installation of the components. It should also be clear that an entire door 58 can be manufactured with the insert holding system 10 and provided to the user, which can be installed in a doorway in the same fashion as a door without the insert holding system 10.

The advantages of the present invention include a method for having the insert holding system applied to any type of door without the door being substantially modified in its method of construction. It also allows for the Insert Hold System to be easily incorporated into existing doors that are already installed in a home where the home owner or resident is the installer of the "conversion kit". This design delivers all of the necessary precision parts as a "retrofit package" greatly simplifying the incorporation of the invention to commercially available and/or existing already installed doors, and/or any relatively planner surface; thus, increasing the commercial application of the invention. Likewise, delivering the aspects of the insert holding system using the methods described in this application significantly reduces the factory retooling necessary for its use in door products. Regarding the through-opening version, this design also has the ability of being interchanged from one side of the door to the other; thus, allowing the removable frame to be switched in its choice of side to be attached. The design of this insert holding system is such that it fits solid core door, and also fits hollow core doors with the addition of the mounting platform.

While a presently preferred and various alternative embodiments of the present invention have been described in sufficient detail above to enable a person skilled in the relevant art to make and use the same, it should be obvious that various other adaptations and modifications can be envisioned by those persons skilled in such art without departing from either the spirit of the invention or the scope of the appended claims.

The invention claimed is:

1. An insert holding system comprising:

a modular housing defining a chamber, a substantially planar insert, wherein the modular housing is configured to receive the substantially planar insert in the chamber, wherein the chamber of the modular housing is open at a first end and at a second end, and wherein the modular housing is configured to be disposed in an opening in a door or a planar surface, wherein the modular housing comprises a first frame and a second frame, wherein the first frame is disposed at the first end of the chamber, and wherein the second frame is adapted to removably attach to the first frame at the second end of the chamber defining the chamber of the modular housing, wherein the substantially planar insert is secured within the chamber by the second frame being attached to the first frame, by sliding the substantially planar insert and the first frame into the chamber without using a tool, and wherein the substantially planar insert and the second frame are removed from the chamber by sliding up and pulling out the second frame without using a tool.

2. The insert holding system of claim 1, further comprising:

a mounting platform configured for receiving the modular housing, the mounting platform being further configured to mount into a through opening defined by a hollow core door, wherein the mounting platform is at least in part disposed in a cavity defined by the skin panels of the hollow core door, and wherein the mounting platform is fastened to the skin panels of the hollow core door.

3. The insert holding system of claim 1, further comprising:

a mounting platform formed integrally with the modular housing forming an insert holding assembly, the insert holding assembly being formed from a plurality of sectional parts, the mounting platform being configured to mount into a through opening defined by a hollow core door, wherein the mounting platform is at least in part disposed in a cavity defined by the skin panels of the hollow core door, and wherein the mounting platform is fastened to the skin panels of the hollow core door.

4. The insert holding system of claim 1, wherein the substantially planar insert comprises a mesh screen.

5. The insert holding system of claim 1, wherein the substantially planar insert comprises a non-translucent insert, chosen from a group comprising a mirror, a poster frame, a picture frame, a poster, a chalk board, a dry erase board, a cork board, and any combination thereof.

6. The insert holding system of claim 1, wherein the substantially planar insert comprises a section of translucent material.

7. The insert holding system of claim 1, wherein the substantially planar insert comprises a section of transparent material.

8. The insert holding system of claim 1, wherein the substantially planar insert comprises a plurality of layers of material.

9. The insert holding system of claim 1, wherein the insert holding system is installed into a hollow core door comprising:

a first door panel on a first side of the hollow core door, a second door panel on a second side of the hollow core door, and an opening in the second door panel of the hollow core door on the second side, wherein the opening does not penetrate through the first door panel on the first side of the hollow core door.

10. A kit for installing an insert holding system in to a preexisting door, the kit comprising:

a modular housing defining a chamber, a substantially planar insert, wherein the modular housing is configured to receive the substantially planar insert in the chamber, wherein the chamber of the modular housing is open at a first end and at a second end, and wherein the modular housing is configured to be disposed in an opening in a door, wherein the modular housing comprises a first frame and a second frame, wherein the first frame is disposed at the first end of the chamber, and wherein the second frame is adapted to removably attach to the first frame at the second end of the chamber defining the chamber of the modular housing, wherein the substantially planar insert is secured within the chamber by the second frame being attached to the first frame, by sliding the substantially planar insert and the first frame into the chamber without using a tool, and wherein the substantially planar insert and the second frame are removed from the chamber by sliding up and pulling out the second frame without using a tool.

11. The kit of claim 10, further comprising:

a mounting platform configured for receiving the modular housing, the mounting platform being further configured to mount into a through opening defined by a hollow core door, wherein the mounting platform is at least in part disposed in a cavity defined by the skin panels of the hollow core door, and wherein the mounting platform is fastened to the skin panels of the hollow core door.

12. The kit of claim 10, further comprising:

a mounting platform formed integrally with the modular housing forming an insert holding assembly, the insert holding assembly being formed from a plurality of sectional parts, the mounting platform being configured to mount into a through opening defined by a hollow core door, wherein the mounting platform is at least in part disposed in a cavity defined by the skin panels of the hollow core door, and wherein the mounting platform is fastened to the skin panels of the hollow core door.

13. The kit of claim 10, wherein the substantially planar insert comprises a non-translucent insert, chosen from a group comprising: a mirror, a poster frame, a picture frame, a poster, a chalk board, a dry erase board, a cork board, and any combination thereof.

14. The kit of claim 10, wherein the substantially planar insert comprises a mesh screen.

15. The kit of claim 10, wherein the substantially planar insert comprises a section of transparent material.

* * * * *